US010118384B2

(12) United States Patent
Abe

(10) Patent No.: US 10,118,384 B2
(45) Date of Patent: Nov. 6, 2018

(54) LIQUID EJECTING APPARATUS

(71) Applicant: SEIKO EPSON CORPORATION, Tokyo (JP)

(72) Inventor: Akira Abe, Nagano (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 15/675,904

(22) Filed: Aug. 14, 2017

(65) Prior Publication Data

US 2018/0086054 A1 Mar. 29, 2018

(30) Foreign Application Priority Data

Sep. 27, 2016 (JP) ..... 2016-187878

(51) Int. Cl.
*B41J 2/045* (2006.01)
*B41J 2/14* (2006.01)

(52) U.S. Cl.
CPC ..... *B41J 2/04541* (2013.01); *B41J 2/0455* (2013.01); *B41J 2/04581* (2013.01); *B41J 2/04588* (2013.01); *B41J 2/04593* (2013.01); *B41J 2/04596* (2013.01); *B41J 2/14233* (2013.01); *B41J 2002/14491* (2013.01)

(58) Field of Classification Search
CPC .. B41J 2/0455; B41J 2/04501; B41J 2/04541; B41J 2/04581
See application file for complete search history.

(56) References Cited

U.S. PATENT DOCUMENTS 6,334,668 B1 * 1/2002 Isamoto ..... B41J 2/04541 347/57
8,851,633 B2 * 10/2014 Kubo ..... B41J 2/14209 347/57
2015/0246530 A1 * 9/2015 Abe ..... B41J 2/04541 347/10

FOREIGN PATENT DOCUMENTS

JP 2005-014469 A 1/2005

* cited by examiner

*Primary Examiner* — Geoffrey S Mruk
*Assistant Examiner* — Scott A Richmond

(57) ABSTRACT

A liquid ejecting apparatus includes a drive circuit board on which a drive circuit which outputs a driving signal obtained by amplifying the original driving signal is mounted; an actuator substrate which includes an ejecting unit including a piezoelectric element which is driven by the driving signal, and ejects liquid when the piezoelectric element is driven; and a head unit a head unit on which a relay board which relays the driving signal to the piezoelectric element from the drive circuit board, the actuator substrate, the relay board, and the drive circuit board are mounted, and which is mounted on a carriage which reciprocates in an X direction as a main scanning direction. A mounting face of the drive circuit board is attached to the relay board so as to be placed in a direction which goes along the X direction in the main scanning direction of the carriage.

14 Claims, 12 Drawing Sheets

<DECODING CONTENTS OF DECODER>

| | PRINT DATA SI | T1 | | T2 | |
|---|---|---|---|---|---|
| | | Sa | Sb | Sa | Sb |
| LARGE DOT | (1, 1) | H | L | H | L |
| MEDIUM DOT | (0, 1) | H | L | L | H |
| SMALL DOT | (1, 0) | L | L | L | H |
| NON-RECORDING | (0, 0) | L | H | L | L |

MSB LSB

LIQUID EJECTING APPARATUS

BACKGROUND

1. Technical Field

The present invention relates to a liquid ejecting apparatus.

2. Related Art

As a printing apparatus which prints an image or a document by ejecting ink, an ink jet printer which ejects ink (liquid) using a piezoelectric element (for example, piezo element) has been known. The piezoelectric elements are provided so as to correspond to a respective plurality of nozzles in a head unit, and are respectively driven according to a driving signal. Due to the driving, liquid of a predetermined quantity is ejected at a predetermined timing from the nozzle, and dots are formed. Since the piezoelectric element is a capacitive load such as a capacitor when considering in an electrical view point, it is necessary to supply a sufficient current in order to cause a piezoelectric element of each nozzle to be operated.

For this reason, an ink jet printer has a configuration in which the original driving signal as the origin of a driving signal is amplified in a drive circuit (amplification circuit), the amplified driving signal is supplied to a head unit as a driving signal, and a piezoelectric element is driven.

Since the head unit is mounted on a carriage which reciprocates in a main scanning direction in general, it is a general configuration in which a drive circuit is provided in a housing of an ink jet printer, and the driving signal amplified in the drive circuit is supplied to the carriage through a flexible flat cable.

In a case in which liquid is ejected by driving a piezoelectric element using a driving signal, a relatively large voltage amplitude of approximately 40 V is necessary for the driving signal; however, since a driving signal with a large amplitude is supplied through the flexible flat cable in the above described configuration, a loss, a deterioration, a noise, and the like, occur. For this reason, a technology in which a drive circuit is mounted on a carriage, and a signal with a large amplitude is not supplied through the flexible flat cable has been proposed (refer to JP-A-2005-14469).

Meanwhile, in recent years, needs for a large printing size and a high speed in printing become remarkable. A reciprocating distance in a carriage becomes long accompanied by a large printing size, and a movement speed in reciprocating also becomes high along with a high speed in printing. For this reason, a considerable lateral G-force (acceleration in direction approximately orthogonal to gravity direction, which occurs accompanied by reciprocating movement) occurs in a drive circuit mounted on a carriage. For this reason, an attachment, or the like, when mounting the drive circuit on the carriage easily causes a problem.

SUMMARY

An advantage of some aspects of the invention is to provide a liquid ejecting apparatus in which, in a case of mounting a drive circuit on a carriage, a problem rarely occurs even when the carriage reciprocates at a high speed.

According to an aspect of the invention, there is provided a liquid ejecting apparatus which includes a drive circuit board on which a drive circuit which outputs a driving signal obtained by amplifying the original driving signal is mounted; an ejecting unit which includes a piezoelectric element driven by the driving signal, and ejects liquid when the piezoelectric element is driven; a relay board which relays the driving signal from the drive circuit board to the piezoelectric element; and a carriage on which the ejecting unit, the relay board, and the drive circuit board are mounted, and reciprocates in a main scanning direction, in which the drive circuit board is attached to the relay board so that a mounting face of the drive circuit board is disposed in a direction which goes along the main scanning direction of the carriage.

According to the liquid ejecting apparatus of the aspect, since the mounting face of the drive circuit board is disposed in the direction which goes along the main scanning direction of the carriage, it is possible to deal with stress which is accompanied by a lateral G-force, and reduce air resistance of the drive circuit board at a time of reciprocating of the carriage. In addition, in order to exhibit the above described effect, the drive circuit may be attached to the mounting face of the drive circuit board in a state in which the mounting face is in a range of within ±10 degrees with respect to the main scanning direction of the carriage.

In the liquid ejecting apparatus according to the aspect, the drive circuit board may include an output terminal through which the driving signal is output, and an input terminal through which the original driving signal, or a signal other than the original driving signal is input.

In the liquid ejecting apparatus according to the aspect, a plurality of the drive circuit boards may be further provided.

In the liquid ejecting apparatus according to the aspect, the drive circuit board may be connected to the relay board through a connector.

In the liquid ejecting apparatus according to the aspect, a support unit which supports the drive circuit board on the relay board may be further included.

In the liquid ejecting apparatus according to the aspect, the drive circuit may include a high side transistor which is connected between a predetermined output end and a feeding point of a high side power supply voltage, a low side transistor which is connected between the output end and a feeding point of a low side power supply voltage, a differential amplifier which outputs a control signal obtained by amplifying a differential voltage between a voltage of the original driving signal and a voltage corresponding to the driving signal, and a selector which, in a first case in which a change in voltage of the original driving signal is rising, and a magnitude of the change in voltage is a threshold value or more, selects the control signal, and causes the control signal to be supplied to a gate terminal of the high side transistor, and which, in a second case in which a change in voltage of the original driving signal is decreasing, and a magnitude of the change in voltage is the threshold value or more, selects the control signal, and causes the control signal to be supplied to a gate terminal of the low side transistor.

In such a configuration, in the first case, the selector may select a signal which turns off the low side transistor, and supply the signal to a gate terminal of the low side transistor, and in the second case, the selector may select a signal which turns off the high side transistor, and supply the signal to a gate terminal of the high side transistor.

In a third case in which a magnitude of the change in voltage is less than the threshold value, the selector may select a signal which turns off the low side transistor, and cause the signal to be supplied to the gate terminal of the low side transistor, and select a signal which turns off the high side transistor, and cause the signal to be supplied to the gate terminal of the high side transistor.

In the liquid ejecting apparatus according to the aspect, the drive circuit may be mounted on one face of the drive circuit board, a separate drive circuit may be mounted on the other face of the drive circuit board, and the relay board may relay a driving signal generated by the separate drive circuit to the piezoelectric element from the drive circuit board.

The liquid ejecting apparatus may be an apparatus which ejects liquid, and also includes a three-dimensional shaping apparatus (so-called 3D printer), a textile printing apparatus, or the like, in addition to a printing apparatus which will be described later.

BRIEF DESCRIPTION OF THE DRAWINGS

The invention will be described with reference to the accompanying drawings, wherein like numbers reference like elements.

FIG. 6 is a diagram for describing a waveform of a driving signal, or the like.

DESCRIPTION OF EXEMPLARY EMBODIMENTS

Hereinafter, an embodiment for performing the invention will be described by taking a printing apparatus as an example with reference to drawings.

Figure 1:
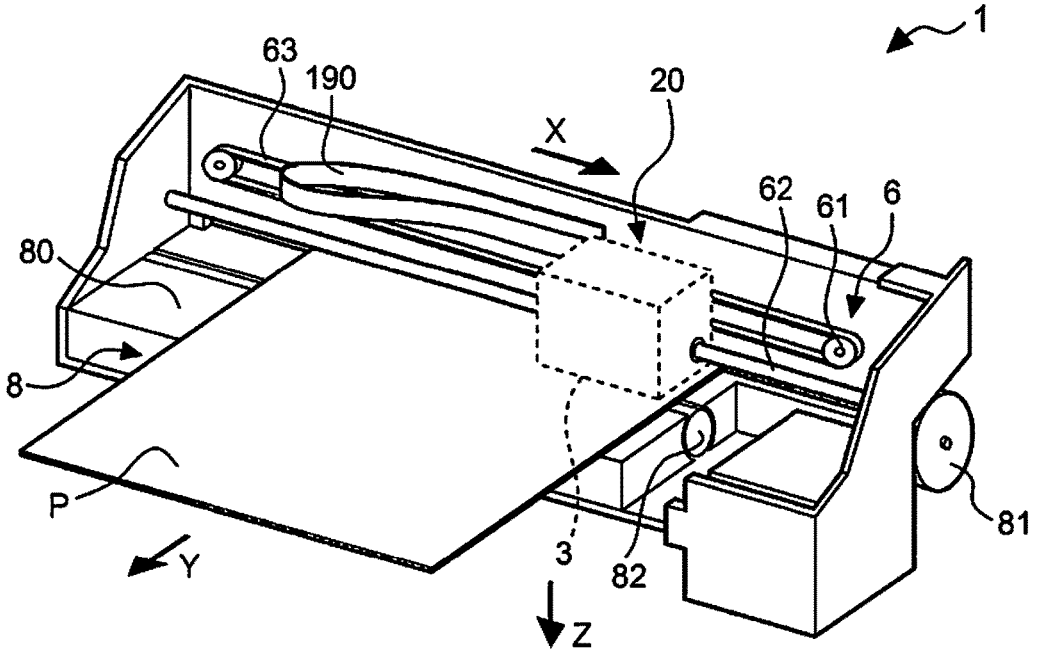
FIG. 1 is a diagram which illustrates a schematic configuration of a printing apparatus.

FIG. 1 is a perspective view which illustrates a schematic configuration of a printing apparatus 1.

The printing apparatus 1 illustrated in FIG. 1 is a type of a liquid ejecting apparatus which forms an ink dot group on a medium P such as paper, by ejecting ink as an example of liquid, and prints an image (including characters, figures, or the like) in this manner.

As illustrated in FIG. 1, the printing apparatus 1 is provided with a movement mechanism 6 which moves (reciprocates) a carriage 20 in a main scanning direction (X direction).

The movement mechanism 6 includes a carriage motor 61 which moves the carriage 20, a carriage guide shaft 62 of which both ends are fixed, and a timing belt 63 which extends approximately in parallel to the carriage guide shaft 62, and is driven by the carriage motor 61.

The carriage 20 is supported by the carriage guide shaft 62 in a reciprocating manner, and is fixed to a part of the timing belt 63. For this reason, when the timing belt 63 is caused to perform forward-reverse traveling using the carriage motor 61, the carriage 20 reciprocates by being guided by the carriage guide shaft 62.

The head unit 3 is mounted on the carriage 20. The head unit 3 includes a plurality of nozzles which eject ink in a Z direction, individually, at a portion of facing the medium P. The head unit 3 is simplified, using a dashed line in FIG. 1; however, the head unit is schematically divided into 4 blocks in order to perform color printing, in practice. Each of the 4 blocks ejects ink of black (Bk), cyan (C), magenta (M), and yellow (Y), respectively.

In addition, the head unit 3 is configured so that various control signals, and the like, are supplied from a main substrate (not illustrated in the figure) through a flexible flat cable 190.

The printing apparatus 1 is provided with a transport mechanism 8 which transports the medium P on a platen 80. The transport mechanism 8 is provided with a transport motor 81 as a driving source, and a transport roller 82 which is rotated by the transport motor 81, and transports the medium P in a sub-scanning direction (Y direction).

In such a configuration, ink is ejected according to print data from a nozzle of the head unit 3 in accordance with main scanning of the carriage 20, and forms an image on the front surface of the medium P by repeating an operation of transporting the medium P using the transport mechanism 8.

Figure 2:
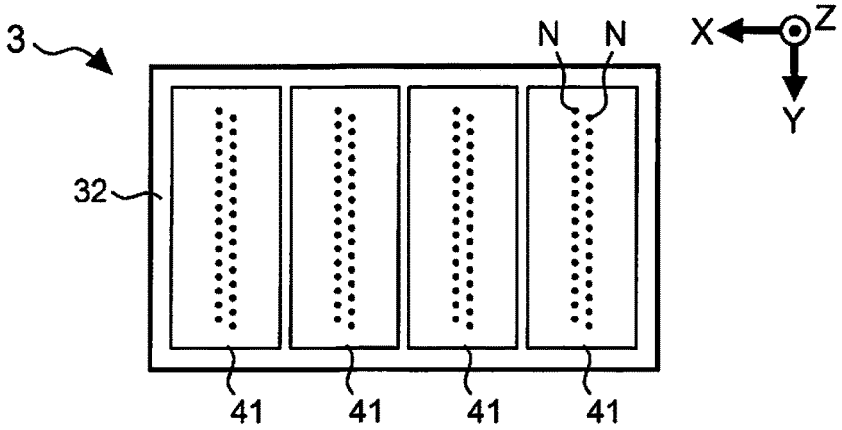
FIG. 2 is a diagram which illustrates an arrangement of nozzles, or the like, of the printing apparatus.

FIG. 2 is a diagram which illustrates a configuration in a case in which an ejecting face of ink in the head unit 3 is viewed from the medium P. Each block is mainly configured of a rectangular parallelepiped actuator substrate. A reference numeral 41 in the figure is a nozzle plate provided on an ejecting face of the actuator substrate.

Four actuator substrates are aligned along the X direction as the main scanning direction, and are disposed so that a longitudinal direction of each actuator substrate goes along the Y direction as the sub-scanning direction. For this reason, four nozzle plates 41 are also arranged in line along the X direction, and are respectively disposed so that a longitudinal direction of the respective nozzle plates 41 goes along the Y direction. In addition, the respective nozzle plates 41 are attached to a mounting plate 32, respectively. A configuration of the actuator substrate will be described later.

Figure 3:
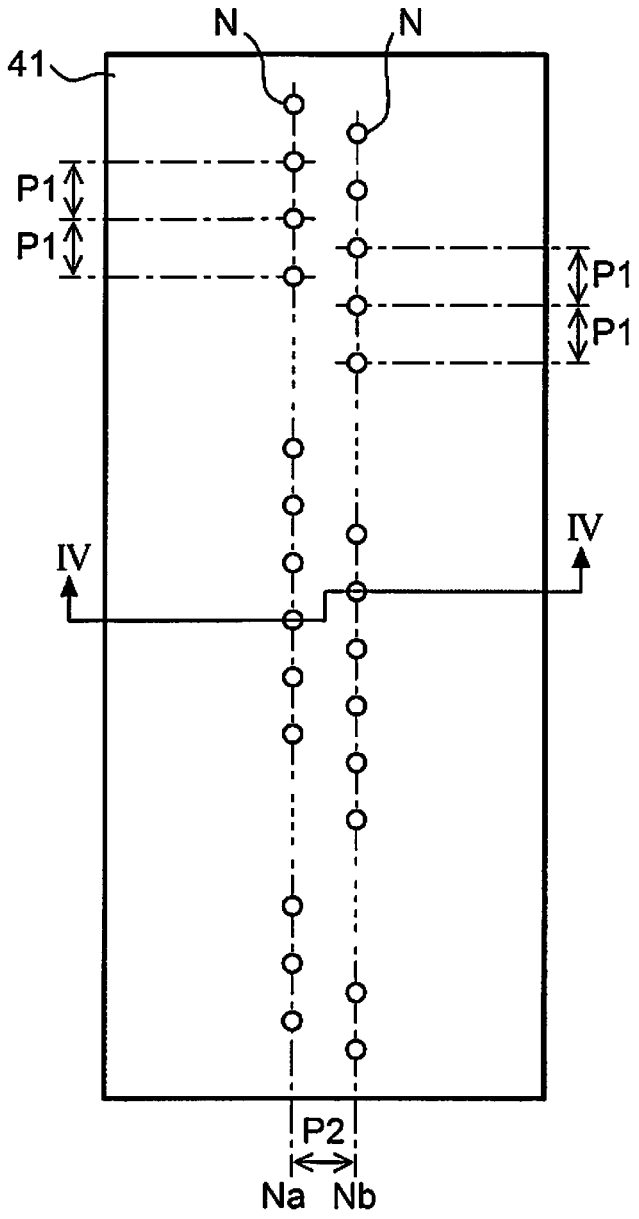
FIG. 3 is a diagram which illustrates the arrangement of the nozzles by enlarging thereof.

FIG. 3 is a diagram which illustrates an arrangement of nozzles.

As illustrated in the figure, a plurality of nozzles N are arranged in two columns on the nozzle plate 41. Here, for ease of descriptions, these two columns are set to nozzle columns Na and Nb, respectively.

In the nozzle columns Na and Nb, the respective plurality of nozzles N are arranged at a pitch P1 along the Y direction as the sub-scanning direction. In addition, the nozzle columns Na and Nb are separated from each other at a pitch P2 in the X direction. Nozzles N which belong to the nozzle column Na and nozzles N which belong to the nozzle column Nb are shifted by a half of the pitch P1 in the Y direction.

When disposing the nozzles N in two nozzle columns of Na and Nb in this manner, by shifting thereof by a half of the pitch P1 in the Y direction, it is possible to double a resolution in the Y direction in practice, compared to a case of one column.

In addition, the number of nozzles N in one nozzle plate 41 is set to m (m is integer of 2 or more), for convenience.

As will be described later, the head unit 3 has a configuration in which a substrate mounted with various circuits is connected to an actuator substrate which includes m nozzles N, and piezoelectric elements which are provided by corresponding to the respective nozzles N of m. Here, for ease of descriptions, a structure of the actuator substrate will be described.

In the descriptions, a connection means a direct or indirect bonding between two or more elements, and one, or two or more intermediate elements are present between the two or more elements.

Figure 4:
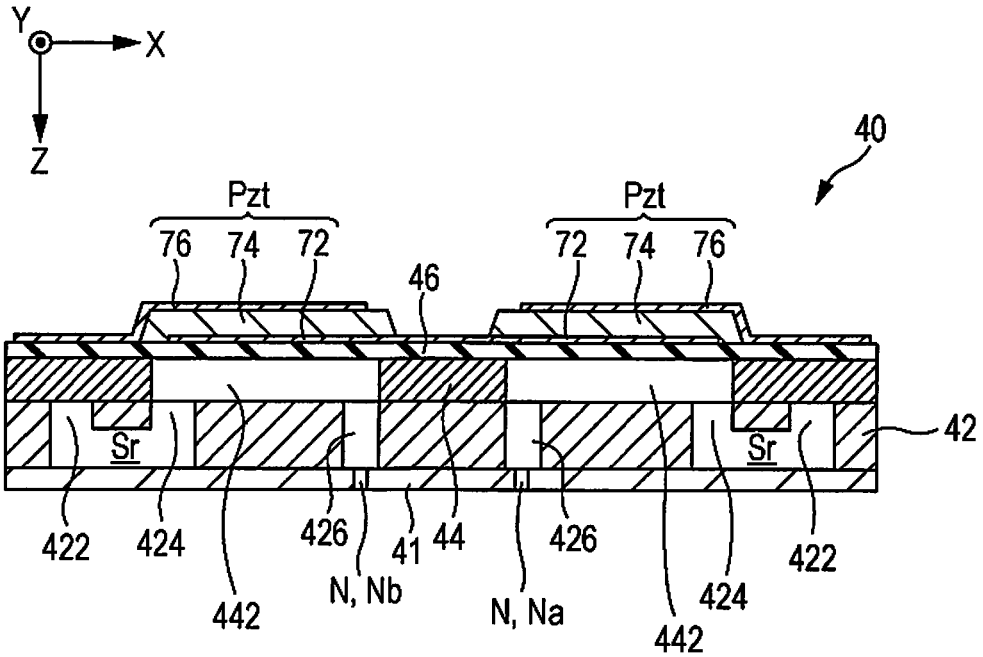
FIG. 4 is a sectional view which illustrates a configuration of an actuator substrate in a head unit.

FIG. 4 is a sectional view which illustrates a structure of an actuator substrate 40 in the head unit 3, and illustrates a section in a case of being cut along line IV-IV in FIG. 3.

As illustrated in FIG. 4, the actuator substrate 40 is a structure in which a pressure chamber substrate 44 and a vibrating plate 46 are provided on a plane on the negative side in the Z direction, and the nozzle plate 41 is provided on a plane on the positive side in the Z direction, in a flow path substrate 42.

Each element of the actuator substrate 40 is a schematic flat plate member which is long in the Y direction, and is fixed to each other using an adhesive, or the like, for example. In addition, the flow path substrate 42 and the pressure chamber substrate 44 are formed of a silicon single crystal substrate, for example.

The nozzles N are formed on the nozzle plate 41. A structure corresponding to the nozzles which belong to the nozzle column Na and a structure corresponding to the nozzles which belong to the nozzle column Nb have a relationship of being shifted by a half of the pitch P1 in the Y direction; however, the structures are formed symmetrically, approximately, except for that. Therefore, hereinafter, descriptions of the structure of the actuator substrate 40 will be made while paying attention to the nozzle column Na.

The flow path substrate 42 is a flat plate member which forms an ink flow path, and in which an opening portion 422, a supply flow path 424, and a communicating flow path 426 are formed. The supply flow path 424 and the communicating flow path 426 are formed in each nozzle N, and the opening portions 422 are formed so as to be continuous over the plurality of nozzles, and have a structure in which ink of a corresponding color is supplied. The opening portion 422 functions as a liquid storage chamber Sr, and a lower face of the liquid storage chamber Sr is formed of the nozzle plate 41, for example. Specifically, the nozzle plate is fixed to the lower face of the flow path substrate 42 so as to block the opening portion 422, and the communicating flow path 426 which communicate with each of the supply flow paths 424, in the flow path substrate 42.

The vibrating plate 46 is provided on the front surface of the pressure chamber substrate 44 on a side opposite to the flow path substrate 42. The vibrating plate 46 is a flat plate-shaped member which can elastically vibrate, and is configured by stacking an elastic film formed of an elastic material such as silicon oxide, and an insulating film formed of an insulating material such as zirconium oxide, for example. The vibrating plate 46 and the flow path substrate 42 face each other with an interval, in the inside of each opening portion 422 of the pressure chamber substrate 44. A space interposed between the flow path substrate 42 and the vibrating plate 46 in the inside of each of the opening portions 422 functions as a cavity 442 which applied pressure to ink. Each cavity 442 communicates with the nozzle N through the communicating flow path 426 of the flow path substrate 42.

Piezoelectric elements Pzt are formed in each nozzle N (cavity 442) on the front surface of the vibrating plate 46 on the side opposite to the pressure chamber substrate 44.

The piezoelectric element Pzt includes a driving electrode 72 which is common to the plurality of piezoelectric elements Pzt formed on a plane of the vibrating plate 46, a piezoelectric body 74 which is formed on a plane of the driving electrode 72, and an individual driving electrode 76 which is formed in each piezoelectric element Pzt on a plane of the piezoelectric body 74. In such a configuration, regions face each other by interposing the piezoelectric body 74 between the driving electrodes 72 and 76 function as the piezoelectric element Pzt.

The piezoelectric body 74 is formed in a process including heating processing (baking), for example. Specifically, the piezoelectric body 74 is formed when forming a piezoelectric material which is applied onto the front surface of the vibrating plate 46 on which the plurality of driving electrodes 72 are formed (for example, milling in which plasma is used) in each piezoelectric element Pzt after performing baking, using heating processing in a baking furnace.

Similarly, a piezoelectric element Pzt corresponding to the nozzle column Nb has a configuration in which the driving electrode 72, the piezoelectric body 74, and the driving electrode 76 are included.

In the example, the common driving electrode 72 is set to a lower layer, and the individual driving electrode 76 is set to a higher layer with respect to the piezoelectric body 74; however, it may be a configuration in which the driving electrode 72 is set to the higher layer, and the driving electrode 76 is set to a lower layer, on the contrary.

A voltage Vout of a driving signal corresponding to a quantity of ink to be ejected is individually applied from the circuit board to the driving electrode 76 which is one end of the piezoelectric element Pzt, and meanwhile, a holding signal of a voltage $V_{BS}$ is commonly applied to the driving electrode 72 which is the other end of the piezoelectric element Pzt.

For this reason, the piezoelectric element Pzt is displaced upwardly or downwardly, according to a voltage applied to the driving electrodes 72 and 76. In detail, when the voltage Vout of the driving signal applied through the driving electrode 76 decrease, a center portion in the piezoelectric element Pzt is bent upwardly with respect to both end portions, and on the other hand, when the voltage Vout increases, the center portion is bent downwardly.

Here, since an internal volume of the cavity 442 increases (decrease in pressure) when the center portion is bent upwardly, ink is drawn in from the liquid storage chamber Sr, and on the other hand, the internal volume of the cavity 442 decreases (increase in pressure) when the center portion is bent downwardly, ink droplets are ejected from the nozzle N according to a degree of decrease. In this manner, when an appropriate driving signal is applied to the piezoelectric element Pzt, ink is ejected from the nozzle N due to a displacement of the piezoelectric element Pzt. For this reason, an ejecting unit which ejects ink is configured of at least the piezoelectric element Pzt, the cavity 442, and the nozzle N.

Subsequently, an electrical configuration of the printing apparatus 1 will be described.

In the printing apparatus 1 according to the embodiment, four actuator substrates 40 corresponding to each color are provided, and a main substrate 100 respectively controls the four actuator substrates 40, independently. Since the four actuator substrates 40 are the same as each other except for an ink color to be ejected, hereinafter, a configuration for controlling one actuator substrate 40 will be described for convenience.

Figure 5:
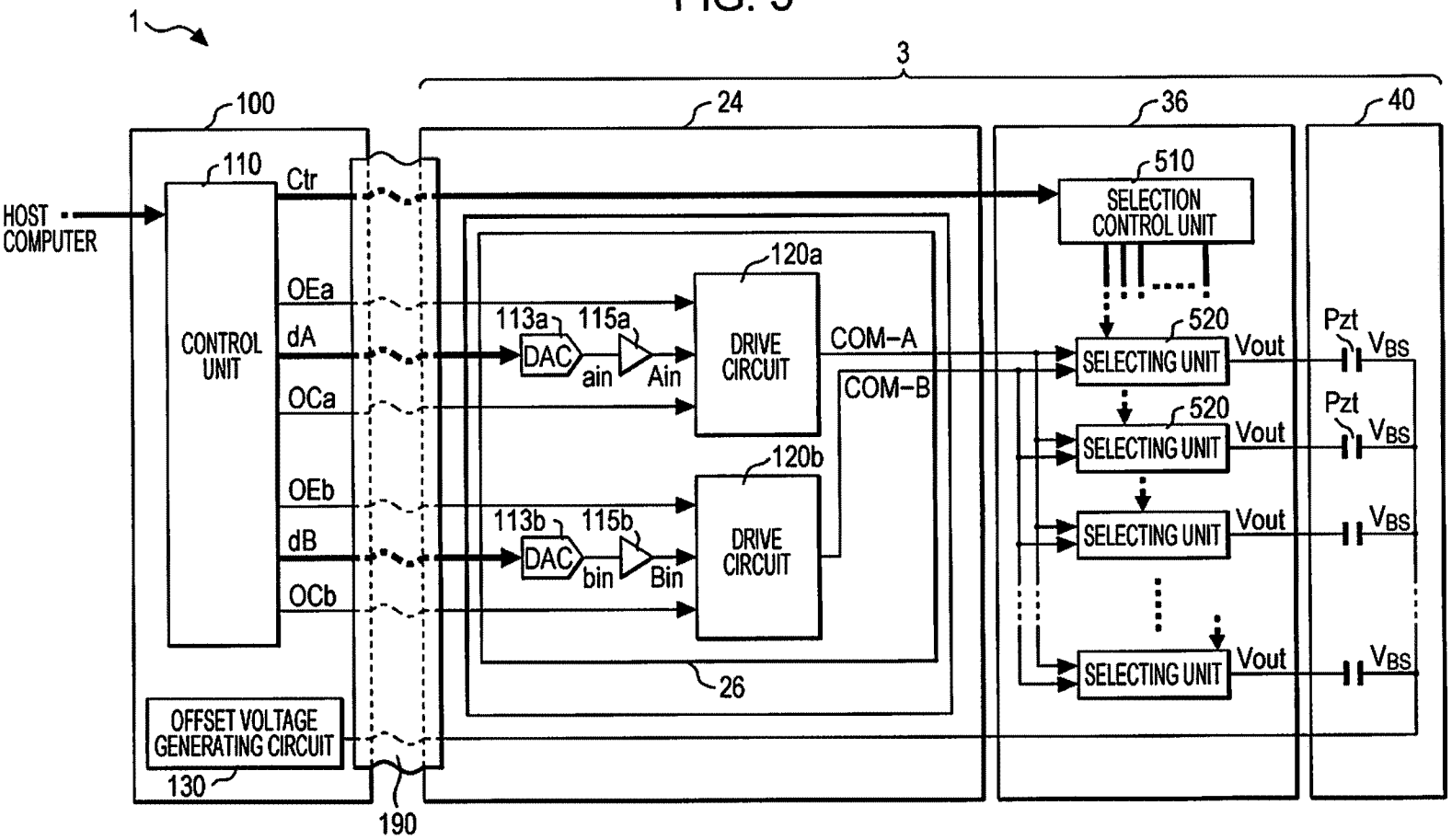
FIG. 5 is a block diagram which illustrates an electrical configuration of the printing apparatus.

FIG. 5 is a block diagram which illustrates an electric configuration for controlling one actuator substrate 40, in the printing apparatus 1.

As illustrated in the figure, the printing apparatus 1 has a configuration in which the head unit 3 is connected to the main substrate 100 through the flexible flat cable 190.

In FIG. 5, the main substrate 100 includes a control unit 110 and an offset voltage generating circuit 130.

Between these, the control unit 110 is a type of microcomputer which includes a CPU, a RAM, a ROM, and the like, and outputs respective various signals, and the like, for controlling each unit, by executing a predetermined program when image data as a printing target is supplied from a host computer, or the like.

Specifically, first, the control unit 110 supplies data dA and dB, signals OEa, OCa, OEb, and OCb to the head unit 3, respectively.

Here, the data dA is digital data (discrete value) which defines a waveform of the driving signal COM-A in time series. Respective signals OEa and OCa are signals as logic levels corresponding to a change in voltage of a waveform of the driving signal COM-A, and are defined by the data dA, respectively, and a detail thereof will be described later.

Similarly, the data dB is digital data which defines a waveform of the driving signal COM-B in time series. Respective signals OEb and OCb are signals as logic levels corresponding to a voltage change of a waveform of the driving signal COM-B which is defined by the data dB, respectively, and a detail thereof will be described later.

Secondly, the control unit 110 supplies various control signals Ctr to the head unit 3 in synchronization with a control with respect to the movement mechanism 6 and the transport mechanism 8. The control signal Ctr includes print data SI (ejecting control signal) for defining a quantity of ink which is caused to be ejected from the nozzle N, a clock signal Sck which is used when transporting the print data, and signals LAT and CH for defining a printing cycle, or the like.

In addition, the control unit 110 controls the movement mechanism 6 and the transport mechanism 8; however, since such a configuration is well known, and descriptions thereof will be omitted.

The offset voltage generating circuit 130 generates the holding signal of voltage $V_{BS}$. In addition, the holding signal of voltage $V_{BS}$ is commonly applied to the other ends of the plurality of piezoelectric elements Pzt in the actuator substrate 40. The holding signal of voltage $V_{BS}$ is a signal for holding the other ends of the plurality of piezoelectric elements Pzt to a constant state, respectively.

Meanwhile, the head unit 3 is roughly classified into a relay board 24, a drive circuit board 26, a COF 36, and the actuator substrate 40.

The drive circuit board 26 and the chip on film (COF) 36 are attached to the relay board 24, as will be described later, the relay board relays various signals which are supplied through the flexible flat cable 190, and relays an output signal from the drive circuit board 26 to the COF 36.

Digital to analog converters (D/A converter (DAC)) 113*a* and 113*b*, voltage amplifiers 115*a* and 115*b*, and drive circuits 120*a* and 120*b* are mounted on the drive circuit board 26.

Among these, the DAC 113*a* converts the digital data dA into an analog signal ain. The voltage amplifier 115*a* amplifies a voltage of the signal ain by 10 times, for example, and supplies thereof to the drive circuit 120*a* as a signal Ain. Similarly, the DAC 113*b* converts the digital data dB into an analog signal bin, and the voltage amplifier 115*b* amplifies a voltage of the signal bin by 10 times, for example, and supplies thereof to the drive circuit 120*b* as a signal Bin.

Though it will be described later in detail, the drive circuit 120*a* outputs the signal Ain as the driving signal COM-A by increasing a driving ability (by converting into low impedance) using the signals OEa and OCa. Similarly, the drive circuit 120*b* outputs the signal Bin as the driving signal COM-B by increasing a driving ability using the signals OEa and OCa.

In addition, the driving signals COM-A and COM-B (signals ain and bin after being subjected to analog conversion, and signals Ain and Bin before impedance conversion) have a trapezoidal waveform, respectively, as will be described later.

The COF 36 is for example, a film-shaped substrate on which a semiconductor circuit is mounted, and the semiconductor circuit includes a selection control unit 510, and a selecting unit 520 which performs one-to-one correspondence to the piezoelectric element Pzt.

Between these, the selection control unit 510 controls a selection in each of the selecting units 520, respectively. In detail, the selection control unit 510 temporarily accumulates print data of a couple of nozzles (piezoelectric elements Pzt) of the head unit 3 which are supplied from the control unit 110 in synchronization with a clock signal, and instructs each of the selecting units 520 to select the driving signals COM-A and COM-B at a start timing of a printing cycle which is defined by a timing signal according to the print data.

Each of the selecting units 520 selects any one of the driving signals COM-A and COM-B (or, selects neither of them) according to the instruction of the selection control unit 510, and applies the signal to one end of a corresponding piezoelectric element Pzt as a driving signal of the voltage Vout.

Since the signal ain (bin) is converted by the DAC 113*a* (113*b*) which is a semiconductor circuit with a low withstand voltage, the signal has relatively small amplitude of approximately 0 to 4 V, for example. In contrast to this, relatively large voltage amplitude of approximately 0 to 40 V for sufficiently driving the piezoelectric element Pzt is necessary for the driving signal COM-A (COM-B) as a combination source of a driving signal which is applied to the piezoelectric element Pzt.

For this reason, it is configured so that a voltage of the signal ain (bin) which is converted by the DAC 113*a* (113*b*) is amplified by the voltage amplifier 115*a* (115*b*), the drive circuit 120*a* (120*b*) performs an impedance conversion with respect to a signal Ain (Bin) obtained through the voltage amplification, and outputs the signal as the driving signal COM-A (COM-B), and a selecting unit 520 corresponding to a certain piezoelectric element Pzt selects the driving signal COM-A or COM-B (or, does not select) according to an ink quantity to be ejected, and applies the signal to one end of the piezoelectric element Pzt.

Meanwhile, as described in FIG. 4, one piezoelectric element Pzt is provided in each nozzle N in the actuator substrate 40. Other ends in respective piezoelectric elements Pzt are commonly connected, and the voltage $V_{BS}$ using the offset voltage generating circuit 130 is applied to the other ends.

According to the embodiment, four gradations of a large dot, a medium dot, a small dot, and non-recording are expressed by causing ink to be ejected twice at largest from one nozzle N with respect to one dot. In order to express the four gradations, according to the embodiment, driving signals COM-A and COM-B of two types are prepared, and a first-half pattern and a second-half pattern are provided in each one cycle, respectively. In addition, it is configured so that one of the driving signals COM-A and COM-B is selected (or, not selected) according to a gradation to be expressed in the first half and the second half in the one cycle, and the signal is supplied to the piezoelectric element Pzt.

Therefore, first, the driving signals COM-A and COM-B are described, and detailed configurations of the selection control unit 510 and the selecting unit 520 for selecting the driving signals COM-A and COM-B will be described thereafter.

Figure 6:
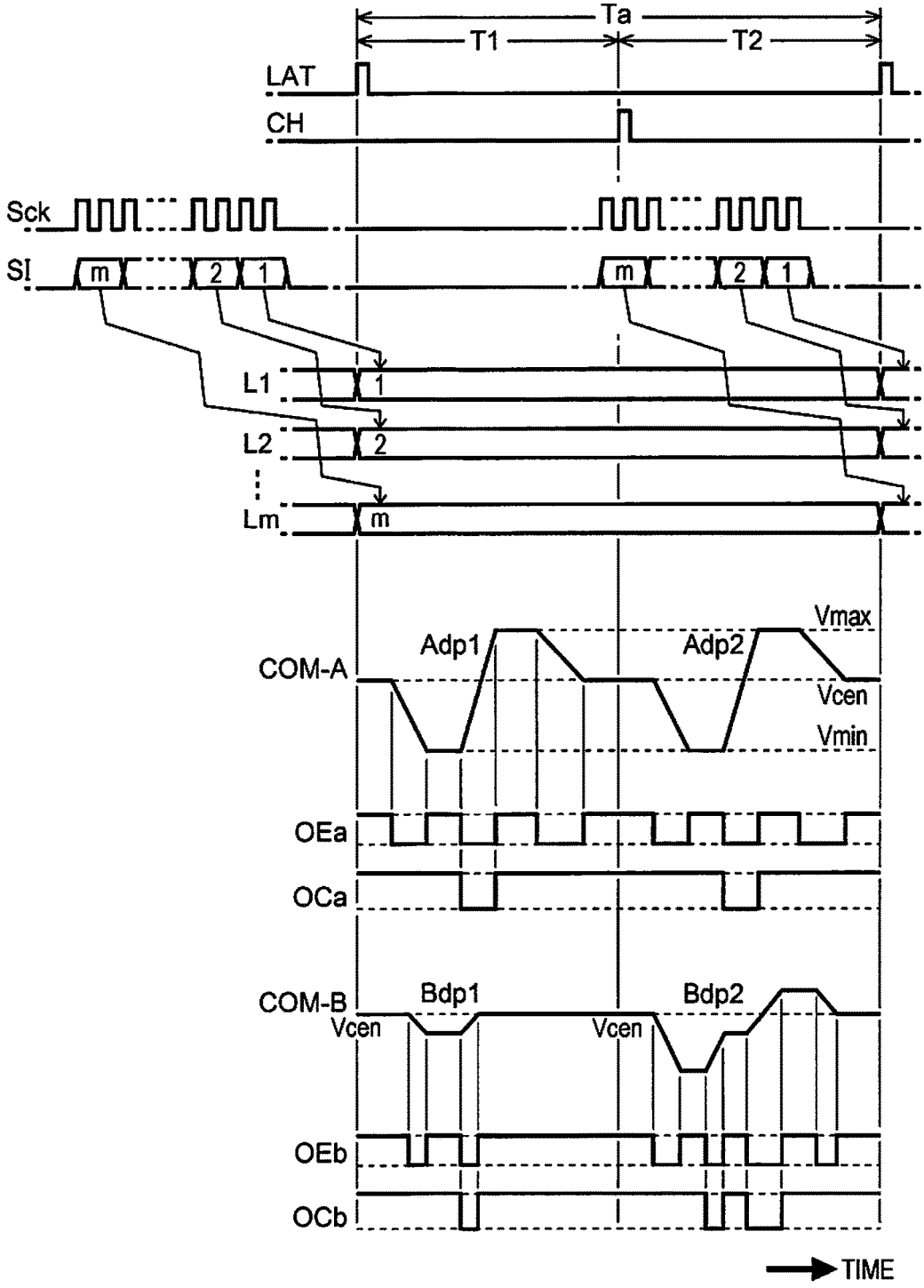

FIG. 6 is a diagram which illustrates waveforms, or the like, of the driving signals COM-A and COM-B.

As illustrated in the figure, the driving signal COM-A has a waveform in which a trapezoidal waveform Adp1 which is disposed in a period T1 from an output of the control signal LAT (rising) to an output of the control signal CH in a printing cycle Ta, and a trapezoidal waveform Adp2 which is disposed in a period T2 from an output of the control signal CH to an output of the subsequent control signal LAT in the printing cycle Ta are repeated.

The trapezoidal waveforms Adp1 and Adp2 in the embodiment have approximately the same waveform as each other, and when assuming that the respective waveforms are supplied to the driving electrode 76 as one end of the piezoelectric element Pzt, the waveforms cause ink of a predetermined quantity, specifically, ink of a moderate quantity to be ejected from a nozzle N corresponding to the piezoelectric element Pzt.

The driving signal COM-B is set to a waveform in which the trapezoidal waveform Bdp1 disposed in the period T1 and a trapezoidal waveform Bdp2 disposed in the period T2 are repeated. The trapezoidal waveforms Bdp1 and Bdp2 in the embodiment are waveforms which are different from each other. Between these, the trapezoidal waveform Bdp1 is a waveform for preventing viscosity of ink from increasing by causing ink in the vicinity of the nozzle N to perform a micro vibration. For this reason, even when it is assumed that the trapezoidal waveform Bdp1 is supplied to one end of the piezoelectric element Pzt, ink droplets are not ejected from the nozzle N corresponding to the piezoelectric element Pzt. In addition, the trapezoidal waveform Bdp2 has a waveform different from that of the trapezoidal waveform Adp1 (Adp2). When assuming that the trapezoidal waveform Bdp2 is supplied to one end of the piezoelectric element Pzt, the waveform causes ink of a quantity smaller than the above described predetermined quantity to be ejected from a nozzle N corresponding to the piezoelectric element Pzt.

Both of the voltages of the trapezoidal waveform Adp1, Adp2, Bdp1, and Bdp2 at a start timing and an ending timing are common in a voltage Vcen. That is, respective voltages of the trapezoidal waveform Adp1, Adp2, Bdp1, and Bdp2 are waveforms which start in the voltage Vcen, and end in the voltage Vcen, respectively.

In addition, in the trapezoidal waveforms Adp1 and Adp2, the highest voltage value is denoted by a Vmax, and the lowest voltage value is denoted by a Vmin, for convenience.

The drive circuit 120*a* (120*b*) performs an impedance conversion with respect to the signal Ain (Bin) in the example, a waveform of the signal Ain (Bin) as an input is a waveform of the driving signal COM-A (COM-B) as is, though there are some errors. Meanwhile, since the signal Ain (Bin) is obtained by amplifying a voltage of the signal ain (bin) by ten times, a waveform of the signal ain (bin) is 1/10 times of a voltage of the signal Ain (Bin). Since the signal ain (bin) is obtained by performing an analog conversion with respect to the data dA (dB), a voltage waveform of the driving signal COM-A (COM-B) is defined by the control unit 110.

The control unit 110 supplies the respective signals OEa and OCa which become the following logic level to the drive circuit 120*a* according to a trapezoidal waveform of the driving signal COM-A, respectively. In detail, first, the control unit 110 sets the signal OEa (designated signal) to an L level over a period in which a voltage is decreased and a period in which a voltage is increased with respect to the driving signal COM-A (signal ain), and sets the signal OEa to an H level over a period in which a voltage of the driving signal COM-A is set to be constant, except for the period. Secondly, the control unit 110 sets the signal OCa to an L level over a period in which a voltage of the driving signal COM-A is increased, and set the signal OCa to an H level over a period other than that.

In this manner, the signal OEa becomes an H level in a period in which a voltage is constant in the trapezoidal waveform of the driving signal COM-A, and the signal OEa becomes an L level in a period in which the voltage is changed. In addition, the signal OCa becomes an H level in a period in which a voltage is decreased, and the signal OCa becomes an L level in a period in which a voltage is increased, in the period in which a voltage of the driving signal COM-A is changed (that is, period in which signal OEa becomes L level).

Similarly, the control unit 110 supplies the respective signals OEb and OCb which become the following logic level to the drive circuit 120*b* according to a trapezoidal waveform of the driving signal COM-B, respectively. In detail, first, the control unit 110 sets the signal OEb to an L level over a period in which a voltage is decreased and a period in which a voltage is increased with respect to the driving signal COM-B (signal bin), and sets the signal OEb to an H level over a period in which a voltage of the driving signal COM-B is set to be constant, except for the period. Secondly, the control unit 110 sets the signal OCb to an L level over a period in which a voltage of the driving signal COM-B is increased, and set the signal OCb to an H level over a period other than that.

In this manner, the signal OEb becomes an H level in a period in which a voltage is constant in the trapezoidal waveform of the driving signal COM-B, and the signal OEb becomes an L level in a period in which the voltage is changed. In addition, the signal OCb becomes an H level in a period in which a voltage is decreased, and the signal OCb becomes an L level in a period in which a voltage is increased, in the period in which a voltage of the driving signal COM-B is changed (that is, period in which signal Oba becomes L level).

Figure 7:
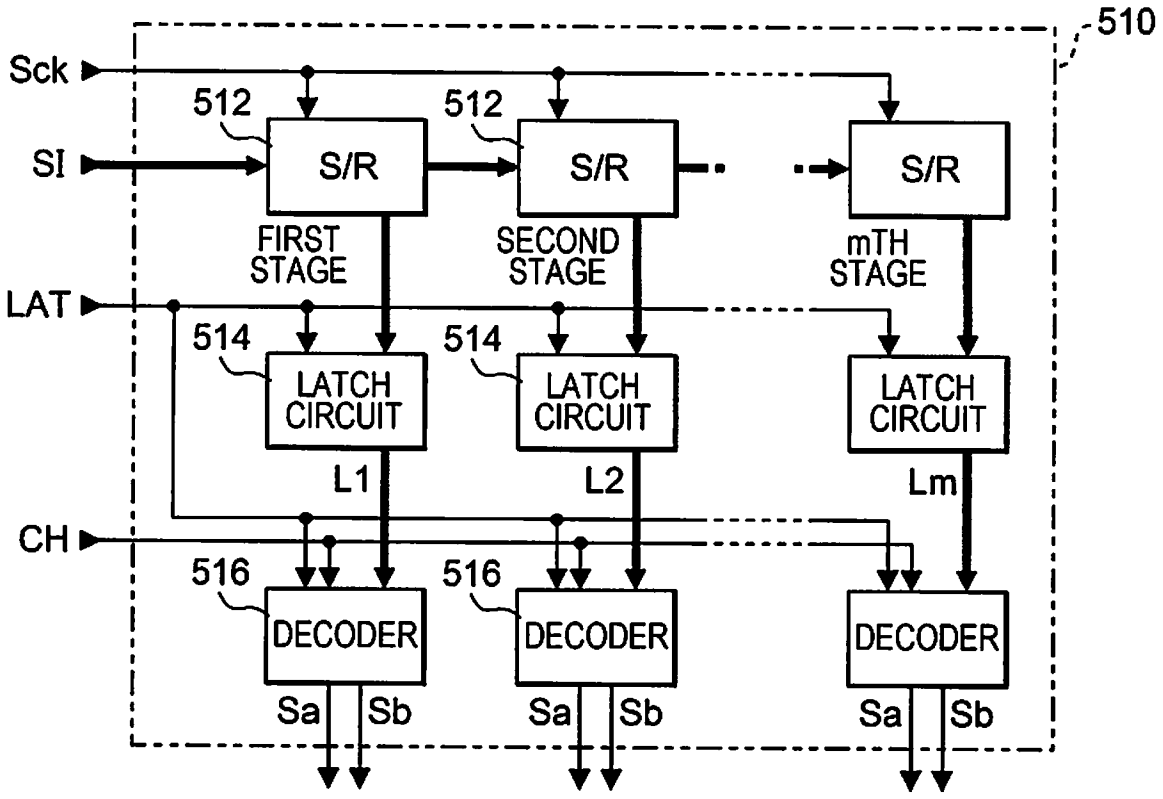
FIG. 7 is a diagram which illustrates a configuration of a selection control unit.

FIG. 7 is a diagram which illustrates a configuration of the selection control unit 510 in FIG. 5.

As illustrated in the figure, the clock signal Sck, the print data SI, the control signals LAT and CH are supplied to the selection control unit 510. In the selection control unit 510, a set of a shift register (S/R) 512, a latch circuit 514, and a decoder 516 is provided corresponding to the respective piezoelectric elements Pzt (nozzles N).

The print data SI is data for defining dots to be formed by all of the nozzles N in a head unit 3 which is focused over the printing period Ta. According to the embodiment, print data of one nozzle is configured of two bits of a high-order bit (MSB) and a low-order bit (LSB) in order to express four gradations of non-recording, a small dot, a medium dot, and a large dot.

The print data SI is supplied from the control unit 110 according to a transportation of the medium P in each nozzle N (piezoelectric element Pzt) in synchronization with the clock signal Sck. A configuration for temporarily holding the print data SI of two bits corresponding to the nozzle N is the shift register 512.

In detail, it is configured so that shift registers 512 of m stages in total corresponding to respective m piezoelectric elements Pzt (nozzles) are vertically connected, and print data SI supplied to the shift register 512 of a first stage located at a position on a left end in the figure is sequentially transmitted to a rear stage (downstream side) according to the clock signal Sck.

In the figure, the shift registers 512 are denoted by a first stage, a second stage, . . . , and mth stage in order, from the upstream side on which the print data SI is supplied, in order to distinguish the shift register.

The latch circuit 514 latches the print data SI held in the shift register 512 at a rising time of the control signal LAT.

The decoder 516 decodes the print data SI of two bits which is latched by the latch circuit 514, outputs selection signals Sa and Sb in each of periods T1 and T2 which is defined by the control signals LAT and CH, and defines a selection in the selecting unit 520.

Figures 8, 9:
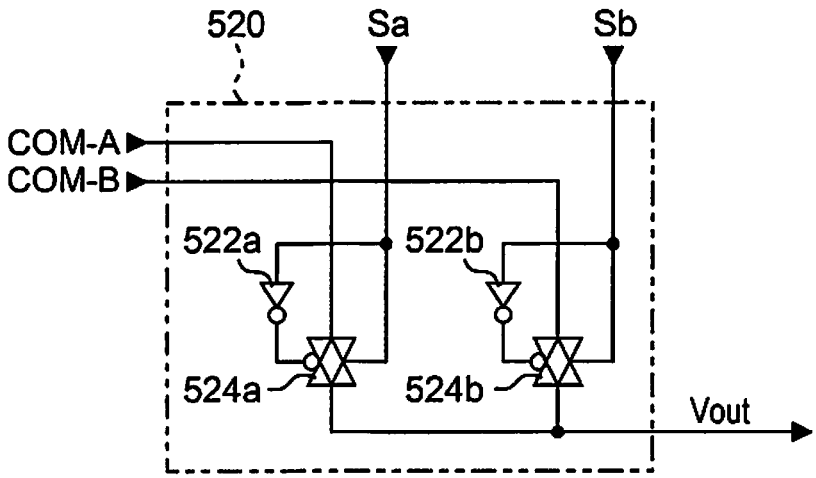
FIG. 8 is a diagram which illustrates decoding contents of a decoder.
FIG. 9 is a diagram which illustrates a configuration of a selecting unit.

FIG. 8 is a diagram which illustrates decoding contents in the decoder 516.

In the figure, the latched print data SI of two bits are denoted by (MSB and LSB). It means that the decoder 516 outputs logic levels of the selection signal Sa and Sb of an H level and an L level, respectively, in the period T1, and an L level and an H level, respectively, in the period T2, when the latched print data SI is (0, 1), for example.

In addition, logic levels of the selection signal Sa and Sb are subjected to a level shift so as to be a high-amplitude logic by a level shifter (not illustrated), compared to logic levels of the clock signal Sck, the print data SI, and the control signals LAT and CH.

FIG. 9 is a diagram which illustrates a configuration of the selecting unit 520 in FIG. 5.

As illustrated in the figure, the selecting unit 520 includes inverters (NOT circuit) 522*a* and 522*b*, and transfer gates 524*a* and 524*b*.

A selection signal Sa from the decoder 516 is supplied to a positive control end to which a circle is not attached in the transfer gate 524*a*, and meanwhile, the selection signal Sa is supplied to a negative control end to which a circle is attached in the transfer gate 524*a*, by being subjected to a logic inversion by the inverter 522*a*. Similarly, the selection signal Sb is supplied to a positive control end of the transfer gate 524*b*, and meanwhile, the selection signal Sb is supplied to a negative control end of the transfer gate 524*b*, by being subjected to a logic inversion by the inverter 522*b*.

The driving signal COM-A is supplied to an input end of the transfer gate 524*a*, and the driving signal COM-B is supplied to an input end of the transfer gate 524*b*. Output ends of the transfer gates 524*a* and 524*b* are commonly connected, and are connected to one end of a corresponding piezoelectric element Pzt.

The transfer gate 524*a* causes the input end and the output end to be electrically connected (ON) when the selection signal Sa is an H level, and causes the input end and the output end not to be electrically connected (OFF) when the selection signal Sa is an L level. Similarly, the transfer gate 524*b* causes the input end and the output end to be turned on or off, according to the selection signal Sb.

As illustrated in FIG. 6, the print data SI is supplied in synchronization with the clock signal Sck for each nozzle N, and is sequentially transmitted in the shift register 512 which corresponds to the nozzle. When a supply of the clock signal Sck is stopped, it enters a state in which the print data SI corresponding to each nozzle is held in the respective shift registers 512.

Here, when the control signal LAT rises, the respective latch circuits 514 latch the print data SI held in the shift register 512 at the same time. In FIG. 6, the numbers L1, L2, . . . , and Lm denote the print data SI which are latched by the latch circuit 514 corresponding to the shift registers 512 of the first stage, the second stage, . . . , and the mth stage.

The decoder 516 outputs logic levels of the selection signals Sa and Sb in each of the periods T1 and T2 according to a dot size defined by the latched print data SI using the contents illustrated in FIG. 8.

That is, first, the decoder 516 sets the selection signals Sa and Sb to an H level and an L level in the period T1, and to the H level and the L level also in the period T2, in a case in which the print data SI is (1, 1), and defines a size of a large dot. Secondly, the decoder 516 sets the selection signals Sa and Sb to an H level and an L level in the period T1, and to an L level and an H level in the period T2, in a case in which the print data SI is (0, 1), and defines a size of a medium dot. Thirdly, the decoder 516 sets the selection signals Sa and Sb to an L level and an L level in the period T1, and to an L level and an H level in the period T2, in a case in which the print data SI is (1, 0), and defines a size of a small dot. Fourthly, the decoder 516 sets the selection signals Sa and Sb to an L level and an H level in the period T1, and to an L level and an L level in the period T2, in a case in which the print data SI is (0, 0), and defines non-recording.

Figure 10:
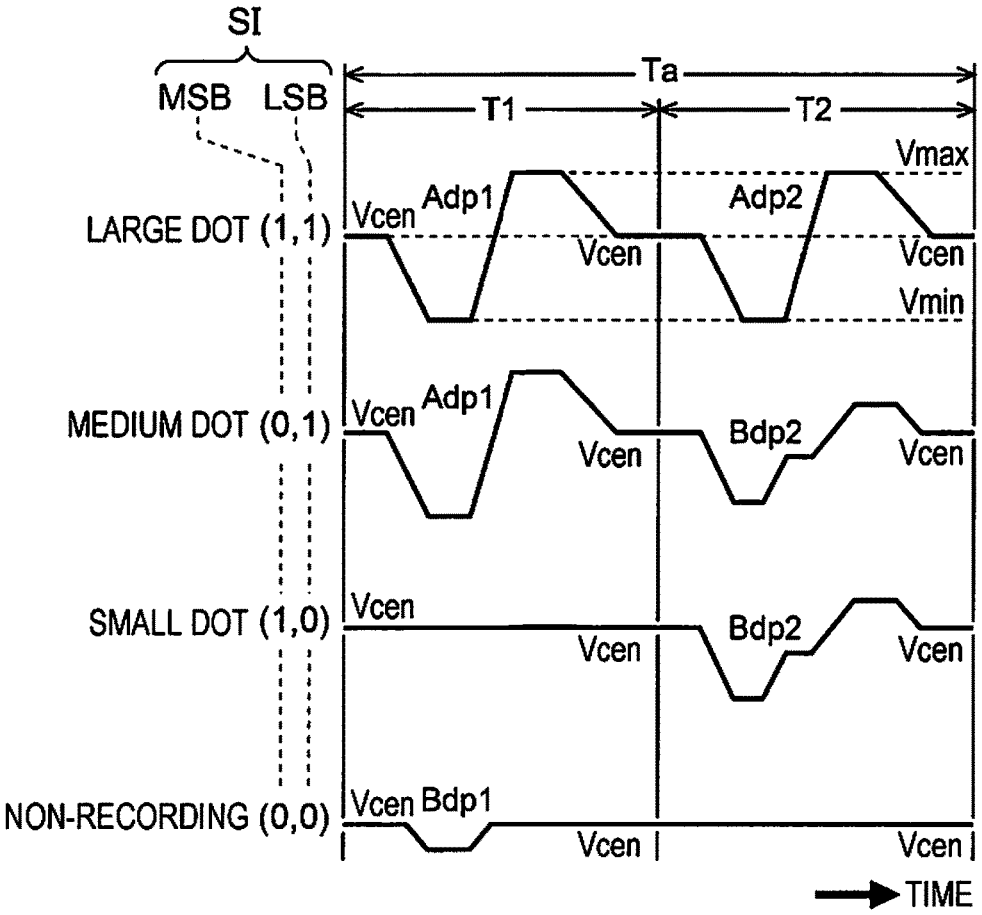
FIG. 10 is a diagram which illustrates a driving signal supplied to a piezoelectric element from the selecting unit.

FIG. 10 is a diagram which illustrates a voltage waveform of a driving signal supplied to one end of the piezoelectric element Pzt by being selected according to the print data SI.

When the print data SI is (1, 1), since the selection signals Sa and Sb become an H level and an L level in the period T1, the transfer gate 524*a* is turned on, and the transfer gate 524*b* is turned off. For this reason, the trapezoidal waveform Adp1 of the driving signal COM-A is selected in the period T1. Since the selection signals Sa and Sb become an H level and an L level also in the period T2, the selecting unit 520 selects the trapezoidal waveform Adp2 of the driving signal COM-A.

When the trapezoidal waveform Adp1 is selected in the period T1, the trapezoidal waveform Adp2 is selected in the period T2, and the waveforms are supplied to one end of the piezoelectric element Pzt as driving signals in this manner, ink of a moderate quantity is ejected in two parts from a nozzle N corresponding to the piezoelectric element Pzt. For this reason, respective ink are landed and combined on the medium P, and as a result, a large dot which is defined by the print data SI is formed.

When the print data SI is (0, 1), since the selection signals Sa and Sb become an H level and an L level in the period T1, the transfer gate 524*a* is turned on, and the transfer gate 524*b* is turned off. For this reason, the trapezoidal waveform Adp1 of the driving signal COM-A is selected in the period T1. Subsequently, since the selection signals Sa and Sb become an L level and an H level in the period T2, the trapezoidal waveform Bdp2 of the driving signal COM-B is selected.

Accordingly, ink of a moderate quantity and a small quantity are ejected in two parts from the nozzle. For this reason, respective ink are landed and combined on the medium P, and as a result, a medium dot which is defined by the print data SI is formed.

When the print data SI is (1, 0), since the selection signals Sa and Sb become an L level together in the period T1, the transfer gates 524*a* and 524*b* are turned off. For this reason, neither the trapezoidal waveform Adp1 nor the trapezoidal waveform Bdp1 is selected in the period T1. In a case in which both of the transfer gates 524*a* and 524*b* are turned off, a path from a connection point of the output ends of the transfer gates 524*a* and 524*b* to one end of the piezoelectric element Pzt enters a high impedance state of not being electrically connected to any portion. However, on both ends of the piezoelectric element Pzt, a voltage immediately before the transfer gate is turned off (Vcen-$V_{BS}$) is held due to its own capacity.

Subsequently, since the selection signals Sa and Sb become an L level and an H level in the period T2, the trapezoidal waveform Bdp2 of the driving signal COM-B is selected. For this reason, since ink of a small quantity is ejected from the nozzle N only in the period T2, a small dot defined by the print data SI is formed on the medium P.

When print data SI is (0, 0), since selection signals Sa and Sb become an L level and an H level in the period T1, the transfer gate 524*a* is turned off, and the transfer gate 524*b* is turned on. For this reason, the trapezoidal waveform Bdp1 of the driving signal COM-B is selected in the period T1. Subsequently, since the selection signals Sa and Sb become an L level together in the period T2, neither the trapezoidal waveform Adp2 nor the trapezoidal waveform Bdp2 is selected.

For this reason, since ink in the vicinity of the nozzle N only performs micro vibration in the period T1, and ink is not ejected, as a result, a dot is not formed. That is, it becomes non-recording which is defined by the print data SI.

In this manner, the selecting unit 520 selects (or, does not select) the driving signal COM-A or COM-B according to an instruction of the selection control unit 510, and applies the signal to one end of the piezoelectric element Pzt. For this reason, each of the piezoelectric elements Pzt is driven according to a size of a dot defined by the print data SI.

In addition, the driving signal COM-A or COM-B illustrated in FIG. 6 is merely an example. In practice, combinations of various waveforms which are prepared in advance are used according to a property, a transport speed, or the like, of the medium P.

Here, an example in which the piezoelectric element Pzt bends upwardly along with a decrease in voltage has been described; however, the piezoelectric element Pzt bends downwardly along with a decrease in voltage when reversing a voltage to be applied to the driving electrodes 72 and 76. For this reason, in a configuration in which the piezoelectric element Pzt bends downwardly along with a decrease in voltage, the driving signals COM-A and COM-B exemplified in the figure have a waveform which is reversed based on the voltage Vcen.

Subsequently, between the drive circuit 120*a* and 120*b*, the drive circuit 120*a* which outputs the driving signal COM-A will be described.

Figure 11:
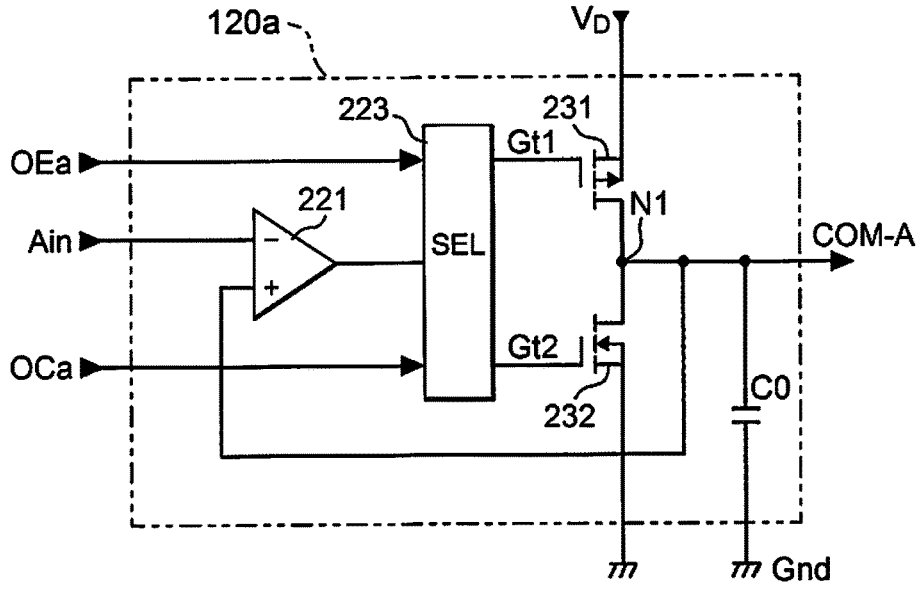
FIG. 11 is a diagram which illustrates a configuration of a drive circuit in the printing apparatus.

FIG. 11 is a diagram which illustrates a configuration of the drive circuit 120*a*. As illustrated in the figure, the drive circuit 120*a* includes a differential amplifier 221, a linear amplifier 222, a selector 223, a pair of transistors, and a capacitor C0.

In the differential amplifier 221, the signal Ain is supplied to a negative input end (−), and meanwhile, the driving signal COM-A as an output is fed back into a positive input end (+). For this reason, the differential amplifier 221 outputs a differential voltage obtained by subtracting a voltage of the negative input end (−) from the voltage of the positive input end (+), that is, a differential voltage obtained by subtracting the voltage of the signal Ain with a large amplitude, as the input, from the voltage of the driving signal COM-A, as the output.

Though it is not particularly illustrated, in the differential amplifier 221, a high side of a power supply is set to a voltage $V_D$ (=42 V), and a low side is set to a ground Gnd (=0 V). For this reason, an output voltage has a range from the ground Gnd to the voltage $V_D$.

However, since an output signal of the differential amplifier 221 is used in order to switch the pair of transistors in the embodiment, the output signal may be considered as a binary logic signal of an H level (voltage $V_D$) and an L level (ground Gnd).

In addition, since there is also a case in which a driving signal is fed back by being stepped down, and meanwhile the original driving signal is output as a driving signal by amplifying a voltage thereof, it may be said that a signal based on a driving signal is fed back into the differential amplifier 221.

The selector 223 selects an output signal of the differential amplifier 221 as a signal Gt1, and supplies to a gate terminal of the transistor 231, and selects an L level as a signal Gt2, and supplies to a gate terminal of the transistor 232, when the signal OEa is an L level, and the signal OCa is an L level.

Meanwhile, the selector 223 selects an H level as the signal Gt1, and supplies to the gate terminal of the transistor 231, and selects the output signal of the differential amplifier 221 as the signal Gt2, and supplies to the gate terminal of the transistor 232, when the signal OEa is an L level, and the signal OCa is an H level.

In addition, the selector 223 supplies the H level to the gate terminal of the transistor 231 as the signal Gt1 regardless of the logic level of the signal OCa, when the signal OEa is the H level, and supplies the L level to the gate terminal of the transistor 232 as the signal Gt2.

In other words, the selector 223 firstly supplies the output signal of the differential amplifier 221 to the gate terminal of the transistor 231, supplies a signal for turning off the transistor 232 to the gate terminal of the transistor 232, when it is a voltage rising period of the driving signal COM-A (signal Ain), secondly, supplies a signal for turning off the transistor 231 to the gate terminal of the transistor 231, and supplies the output signal of the differential amplifier 221 to the gate terminal of the transistor 232 when it is a voltage decreasing period of the driving signal COM-A, and thirdly, supplies a signal for turning off the transistor 231 to the gate terminal of the transistor 231, and supplies a signal for turning off the transistor 232 to the gate terminal of the transistor 232, when it is a period in which a voltage of the driving signal COM-A is even.

The pair of transistors is configured of the transistor 231 and the transistor 232. For this reason, the transistor 231 on the high side (high side transistor) is a P channel-type field effect transistor, for example, and the high side voltage $V_D$ of the power supply is applied to the source terminal. The transistor 232 on the low side (low side transistor) is an N channel-type field effect transistor, and is grounded to the ground Gnd in which the source terminal becomes the low side of the power supply.

The terminals of the transistor 231 and the transistor 232 are connected to each other, and become a node N1 as the output end of the drive circuit 120*a*. That is, it is a configuration in which the driving signal COM-A is output from the nod N1.

The node N1 is connected to the positive input end (+) of the differential amplifier 221.

In addition, the capacitor C0 is provided in order to prevent abnormal oscillation, or the like, one end is connected to the node N1, and the other end is grounded to the ground Gnd with a constant potential, for example.

Here, the drive circuit 120*a* which outputs the driving signal COM-A has been described; however, a configuration of the drive circuit 120*b* which outputs the driving signal COM-B is the same as that of the drive circuit 120*a*, and only the input signal and the output signal are different. That is, the drive circuit 120*b* has a configuration in which the signal OEb is input instead of the signal OEa, the signal OCb is input instead of the signal OCa, and the signal Bin is input instead of the signal Ain, respectively, and meanwhile, the driving signal COM-B is output from the node N1.

Subsequently, operations of the drive circuit 120*a* and the drive circuit 120*b* will be described by exemplifying the drive circuit 120*a* which outputs the driving signal COM-A.

Figure 12:
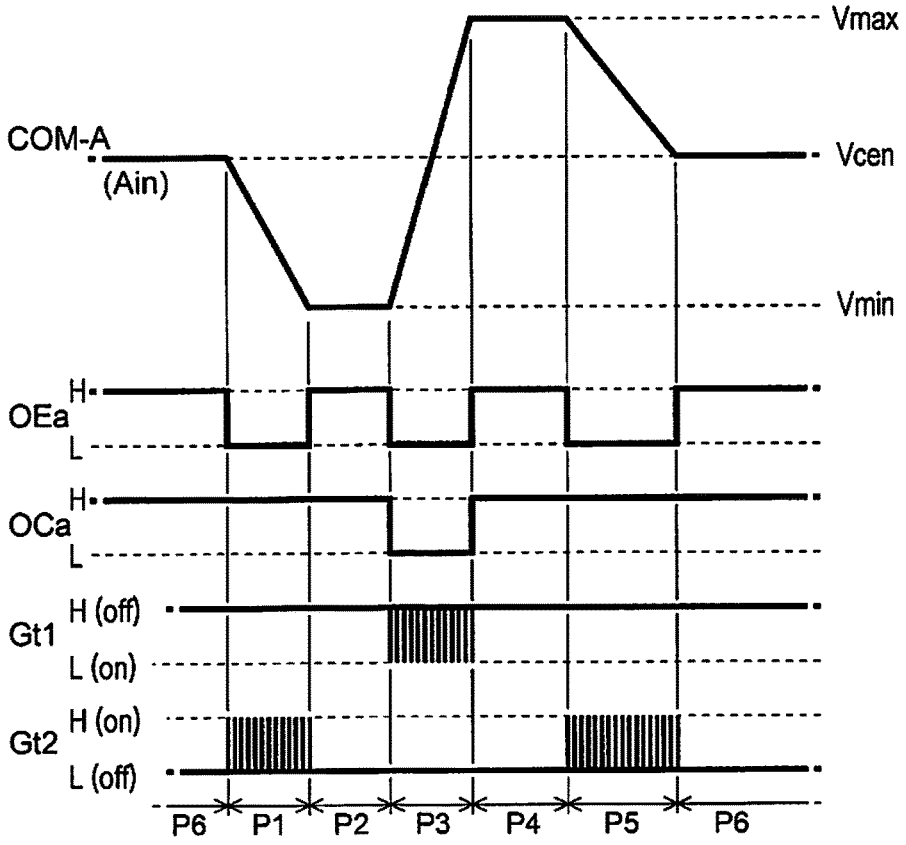
FIG. 12 is a diagram for describing an operation of the drive circuit.

FIG. 12 is a diagram which illustrates a voltage waveform in each unit for describing the operation of the drive circuit 120*a*.

In the figure, since the signal Ain is a signal before performing an impedance conversion of the driving signal COM-A, the signal has approximately the same waveform as that of the driving signal COM-A. In addition, as described above, since the driving signal COM-A has a waveform in which two trapezoidal waveforms Adp1 and Adp2 which are the same in a printing period Ta are repeated, the signal Ain also has the same repeated waveform.

FIG. 12 illustrates one trapezoidal waveform in such repeated waveforms. In the figure, a period P1 is a period in which the signal Ain decreases from the voltage Vcen to the voltage Vmin, a period P2 which is continuous to the period P1 is a period in which the signal Ain becomes constant in the voltage Vmin, a period P3 which is continuous to the period P2 is a period in which the signal Ain increases from the voltage Vmin to the voltage Vmax, a period P4 which is continuous to the period P3 is a period in which the signal Ain becomes constant in the voltage Vmax, and a period P5 which is continuous to the period P4 is a period in which the signal Ain decreases from the voltage Vmax to the voltage Vcen.

For ease of descriptions, vertical scales are not essential for the respective plurality of voltage waveforms in FIG. 12.

First, the period P1 is a voltage decreasing period of the driving signal COM-A (Ain). For this reason, since the signal OEa becomes an L level, and the signal OCa becomes an H level in the period P1, the selector 223 selects the H level as the signal Gt1, and selects the output signal of the differential amplifier 221 as the signal Gt2.

Since the signal Gt1 is an H level in the period P1, the P channel-type transistor 231 is turned off.

Meanwhile, in the period P1, first, the voltage of the signal Ain decreases earlier than the voltage of the node N1. In other words, the voltage of the node N1 is the voltage of the signal Ain or more. For this reason, a voltage of the output signal of the differential amplifier 221 which is selected as the signal Gt2 becomes high according to a difference in voltage between them, and approximately leans toward the H level. Since the transistor 232 is turned on when the signal Gt2 becomes the H level, the voltage Vout decreases. In addition, in practice, the voltage of the node N1 smoothly decreases without decreasing to the ground Gnd at once due to the capacitor C0, and a capacity of the piezoelectric element Pzt as a load.

When the voltage of the node N1 decreases compared to that of the signal Ain, the signal Gt2 becomes an L level, and the transistor 232 is turned off. In addition, since the voltage of the node N1 is held by the capacitor C0 and the capacity of the piezoelectric element Pzt, even when the transistor 232 is turned off, the voltage does not become unstable.

When the transistor 232 is turned off, the decrease in voltage of the node N1 stops; however, since the decrease in voltage of the signal Ain is continuous, the voltage of the node N1 becomes the voltage of the signal Ain or more again. For this reason, the signal Gt2 becomes the H level, and the transistor 232 is turned on again.

In the period P1, the signal Gt2 is alternately switched between the H level and the L level, and due to this, the transistor 232 performs the operation of repeating ON and OFF, that is, a switching operation. Due to the switching operation, the voltage of the node N1 is controlled so as to follow the decrease in voltage of the signal Ain.

Subsequently, the period P2 is a period in which the driving signal COM-A (Ain) becomes constant in the voltage Vmin. For this reason, since the signal OEa is an H level in the period P2, the selector 223 selects the H level as the signal Gt1, and selects the L level as the signal Gt2, and as a result, the transistors 231 and 232 are turned off together.

For this reason, the node N1 in the period P2 is approximately held in the voltage Vmin at a time of the switching operation in the period P1.

The period P3 is a voltage rising period of the driving signal COM-A (Ain). For this reason, since the signal OEa become an L level, and the signal OCa becomes an L level in the period P3, the selector 223 selects the output signal of the differential amplifier 221 as the signal Gt1, and selects the L level as the signal Gt2.

Since the signal Gt2 is the L level in the period P3, the N channel-type transistor 232 is turned off.

Meanwhile, in the period P3, first, the signal Ain increases earlier than the voltage of the node N1. In other words, the voltage of the node N1 becomes lower than that of the signal Ain. For this reason, the voltage of output signal of the differential amplifier 221 selected as the signal Gt1 becomes low according to a difference in voltage between them, and approximately leans toward the L level. Since the transistor 231 is turned on when the signal Gt1 becomes the L level, the voltage Vout increases. In addition, the voltage Vout smoothly increases without increasing to the voltage $V_D$ at once in practice, due to the capacitor C0 and the piezoelectric element Pzt.

When the voltage of the node N1 becomes the voltage of the signal Ain or more, the signal Gt2 becomes the H level, and the transistor 231 is turned off. In addition, since the voltage of the node N1 is held by the capacitor C0 and the capacity of the piezoelectric element Pzt, even when the transistor 231 is turned off, the voltage does not become unstable.

When the transistor 231 is turned off, the increase in voltage of the node N1 stops; however, since the increase in voltage of the signal Ain is continuous, the voltage of the node N1 becomes lower than that of the signal Ain again. For this reason, the signal Gt1 becomes the L level, and the transistor 231 is turned on again.

In the period P3, the signal Gt1 is alternately switched between the H level and the L level, and due to this, the transistor 231 performs a switching operation. Due to the switching operation, the voltage of the node N1 is controlled so as to follow the increase in voltage of the signal Ain.

The period P4 is a period in which the driving signal COM-A (Ain) becomes constant in the voltage Vmax. For this reason, since the signal OEa becomes an H level in the period P4, the selector 223 selects the H level as the signal Gt1, and selects the L level as the signal Gt2, and as a result, the transistor 231 and transistor 232 are turned off together.

For this reason, in the period P4, the node N1 is approximately held in the voltage Vmax at a stop time of the switching operation in the period P3.

The period P5 is a voltage decreasing time of the driving signal COM-A (Ain). For this reason, the same operation as that in the period P1 is performed in the period P5. That is, the signal Gt2 is alternately switched between an H level and an L level, the transistor 232 performs a switching operation due to this, and the voltage of the node N1 is controlled so as to follow the decrease in voltage of the signal Ain.

The period P6 after the period P5 is a period in which the driving signal COM-A (Ain) becomes constant in the voltage Vcen. For this reason, since the signal OEa becomes an H level in the period P6, the selector 223 selects the H level as the signal Gt1, selects the L level as the signal Gt2, and as a result, the transistors 231 and 232 are turned off together.

For this reason, the node N1 in the period P6 is approximately held in the voltage Vcen at a stop time of the switching operation in the period P5.

According to the drive circuit 120*a* illustrated in FIG. 11, the following operations are performed in each of periods P1 to P6.

That is, in the periods P1 and P5 in which the voltage of the signal Ain decreases, the respective voltages of the node N1 are controlled so as to follow the voltage of the signal Ain, due to a switching operation of the transistor 232 in the periods P1 and P5 in which the voltage of the signal Ain decrease, and due to a switching operation of the transistor 231 in the period P3 in which the voltage of the signal Ain rises.

Meanwhile, since the transistors 231 and 232 are turned off in the periods P2, P4, and P6 in which the voltage of the signal Ain becomes constant, the node N1 holds a voltage at a stop time of the switching operation.

According to such a drive circuit 120*a*, the transistors 231 and 232 do not perform a switching operation in the periods P2, P4, and P6 in which a voltage Vin of the signal Ain becomes constant compared to a class-D amplification in which switching is performed all the time. In addition, a low pass filter (LPF) which demodulates a switching signal, particularly, an inductor such as a coil is necessary in the class-D amplification; however, such an LPF is not necessary in the drive circuit 120*a*. For this reason, according to the drive circuit 120*a*, it is possible to suppress a switching operation or power consumed in the LPF compared to the class-D amplification, and in addition, it is possible to make a circuit simple and small.

Here, the drive circuit 120*a* which outputs the driving signal COM-A has been exemplified; however, the same operation is performed for the drive circuit 120*b* which outputs the driving signal COM-B. In detail, the waveform of the driving signal COM-B, and the signals OEb and OCb with respect to the waveform are just as described in FIG. 6, and the driving signal COM-B with a voltage which follows a voltage of a signal Bin is output also in the drive circuit 120*b*.

A waveform of the driving signal COM-A (COM-B) is not limited to the trapezoidal waveform, and may be a waveform with continuity in inclination such as a sine wave.

In a case of outputting such a waveform, when it is the drive circuit 120*b*, for example, and a change in voltage of the driving signal COM-A (voltage of signal Ain) is relatively large, specifically, the signal OEa is set to an L level when the change in voltage per unit time is larger than a predetermined threshold value, and in the meantime, the signal OCa may be set to an H level at a voltage decrease time, and the signal OCa may be set to an L level at a voltage increase time. When it is the drive circuit 120*a*, for example, and a change in voltage of the driving signal COM-B (voltage of signal Bin) is relatively large, specifically, the signal OEb is set to an L level when the change in voltage per unit time is larger than a predetermined threshold value, and in the meantime, the signal OCb may be set to an H level at a voltage decrease time, and the signal OCb may be set to an L level at a voltage increase time.

Meanwhile, in the printing apparatus 1 according to the embodiment, four actuator substrates 40 which correspond to each color of Bk, C, M, and Y are provided in the head unit 3. Since a driving signal is supplied to one actuator substrate 40 using one set of the DAC 113*a* and 113*b*, the voltage amplifiers 115*a* and 115*b*, the drive circuits 120*a* and 120*b*, and the COF 36, four of the above described set are necessary in the head unit 3.

In the embodiment, the number of actuator substrates 40 in the head unit 3 is set to "4"; however, it can be "5" or more, or less than "4" depending on a model. That is, regarding the number of actuator substrates 40, it is necessary to deal with a different situation depending on a mode. Meanwhile, the above described set has a specific character in the actuator substrate 40.

In order to deal with a situation in which the number of actuator substrates 40 is different, it is preferable to adopt a configuration in which a circuit of the above described set is mounted on a drive circuit board, and the drive circuit board is caused to correspond to the actuator substrate 40. According to the configuration, it is possible to increase or decrease a circuit board which corresponds to the above described set, even when the number of actuator substrates 40 is different.

In the embodiment, one circuit board (drive circuit board) mounted with the above described circuit of one set is caused to correspond to one actuator substrate 40, in consideration of such a situation. In addition, in the embodiment, since the actuator substrate 40 is set to four, the number of drive circuit board is also set to "four".

When considering easiness in assembling, maintenance, or the like, at a manufacturing time, it is preferable to adopt a configuration in which a plurality of (four in embodiment) drive circuits are attached to a board (relay board) which is fixed to the carriage 20. However, a point which should be considered in such a configuration is how to attach the plurality of drive circuits boards to the relay board which is fixed to the carriage 20. The reason for this is that, when the carriage 20 reciprocates at high speed, that is, when acceleration and deceleration are repeated, a strong lateral G-force occurs in the carriage 20 in the acceleration-deceleration direction.

Therefore, an attaching method of the drive circuit board in which such a point is taken into consideration will be described.

Figure 13:
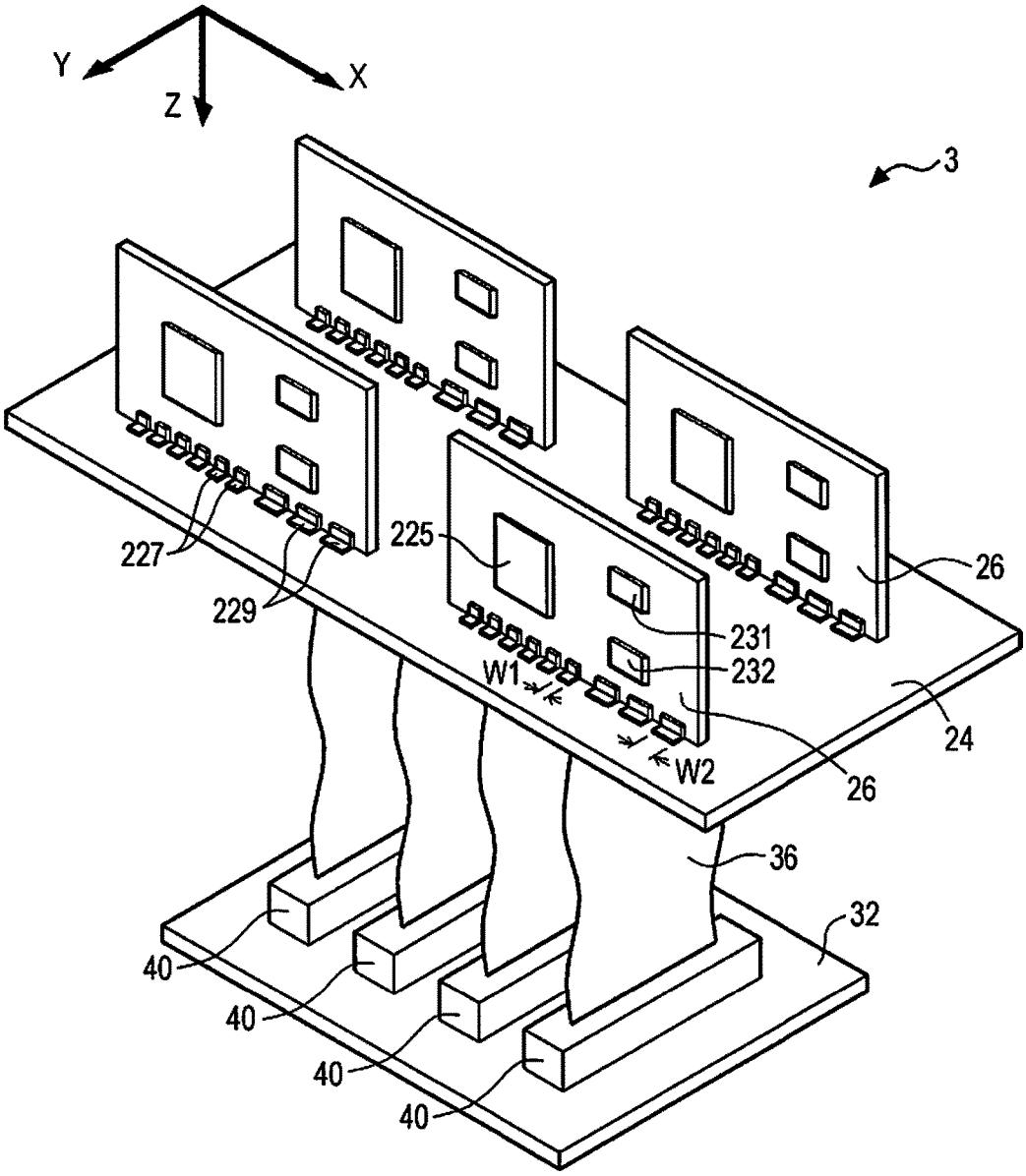
FIG. 13 is a perspective view which illustrates a connection structure of a substrate in the head unit.

FIG. 13 is a perspective view which illustrates a connection structure of the substrate in the head unit 3.

As illustrated in the figure, the relay board 24 is fixed to a wall face (not illustrated) of the head unit 3 so that a plane of the substrate is placed along the XY plane.

According to the embodiment, four actuator substrates 40 corresponding to each color are provided, and the set of the drive circuits 120*a* and 120*b*, DACs 113*a* and 113*b*, and the voltage amplifiers 115*a* and 115*b* is provided corresponding to each of the actuator substrates 40. In a case in which one set is mounted on one drive circuit board 26, the number of drive circuit boards 26 becomes "4" in the configuration in which the actuator substrate 40 is provided corresponding to each color of Bk, C, M, and Y.

According to the embodiment, the four drive circuit boards 26 are attached to the relay board 24 on a top face in the figure in a matrix of 2 rows and 2 columns, for example, so that respective board faces are placed along the XZ plane. In other words, the four drive circuit boards 26 are attached to the relay board 24 in an erecting manner, and in which respective board faces are placed along the X direction as the main scanning direction.

The relay board 24 supplies various signals from the control unit 110 which are received through the flexible flat cable 190 which is not illustrated in FIG. 13 to the respective four drive circuit boards 26, and meanwhile, the relay board supplies the driving signals COM-A and COM-B from the respective four drive circuit boards 26 to the COF 36 which corresponds to the respective drive circuit boards.

Figure 14:
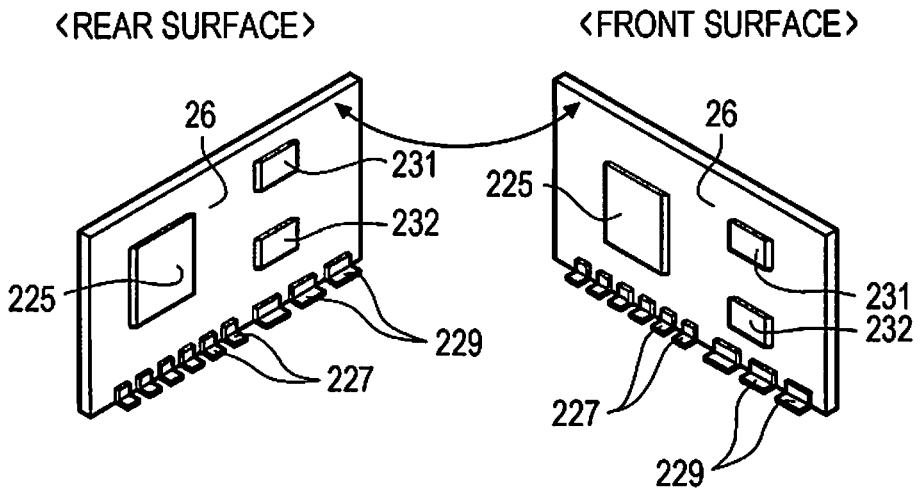
FIG. 14 is a diagram which illustrates a mounting example of the front surface and the rear surface in a drive circuit board.

FIG. 14 is a diagram which illustrates mounting examples on the front surface and the rear surface on the board face of the drive circuit board 26. The semiconductor circuit 225 for outputting the driving signal COM-A, and the transistors 231 and 232 are mounted on the front surface (face on positive side in Y direction in FIG. 13) on the board face of the drive circuit board 26. In detail, the semiconductor circuit 225, and the transistors 231 and 232 are mounted on the front surface of the drive circuit board 26, in a state of being arranged on the left side and the right side, respectively, when the board face of the drive circuit board 26 is viewed planarly, in a state of placing the relay board 24 on the low side. The semiconductor circuit 225 mounted on the front surface is configured by integrating the DAC 113*a*, the voltage amplifier 115*a*, the differential amplifier 221 which configures the drive circuit 120*a*, and the selector 223.

A plurality of (six in figure) L-shaped input terminals 227 for inputting various signals from the control unit 110 are provided on the left side (semiconductor circuit 225 side) of an attaching side to the relay board 24, among four sides of the drive circuit board 26. In addition, a plurality of (three in figure) L-shaped output terminals 229 for outputting the driving signal COM-A to the COF 36 in parallel are provided on the right side (transistors 231 and 232 side) of the attaching side.

Each of the input terminals 227 and the output terminals 229 are respectively soldered to a wiring pattern formed on the relay board 24, and a wiring pattern formed on the drive circuit board 26. In this manner, the drive circuit board 26 is fixed to the relay board 24 in a state of being erected.

Similarly, the semiconductor circuit 225 for outputting the driving signal COM-B, and the transistors 231 and 232 are mounted on the rear surface (face on negative side in Y direction in FIG. 13) in the board face of the drive circuit board 26.

In detail, the semiconductor circuit 225, and the transistors 231 and 232 are mounted on the rear surface of the drive circuit board 26, in a state of being arranged on the left side and the right side, respectively, when the board face of the drive circuit board 26 is viewed planarly, in a state of placing the relay board 24 on the low side. The semiconductor circuit 225 mounted on the rear surface is configured by integrating the DAC 113*b*, the voltage amplifier 115*b*, the differential amplifier 221 which configures the drive circuit 120*b*, and the selector 223.

A plurality of input terminals 227 for inputting various signals from the control unit 110 are provided on the left side (semiconductor circuit 225 side) of an attaching side to the relay board 24, among four sides of the drive circuit board 26, and a plurality of output terminals 229 for outputting the driving signal COM-B to the COF 36 in parallel are provided on the right side (transistors 231 and 232 side) of the attaching side.

A width W1 in the input terminal 227 in a direction of the above described attaching side is set to be smaller than a width W2 in the output terminal 229 in a direction of the above described attaching side. In other words, the width W2 in the output terminal 229 is set to be larger than the width W1 in the input terminal 227.

In FIGS. 13 and 14, only the semiconductor circuit 225, and the transistors 231 and 232 are illustrated on the mounting face of the drive circuit board 26, and other elements such as the capacitor C0 are omitted.

Meanwhile, in FIG. 13, one end of the four COFs 36 corresponding to each color, respectively, is connected to the lower face of the relay board 24, for example. It is configured so that the other end of the COF 36 is connected to the actuator substrate 40 of a corresponding color, and the driving signal COM-A or COM-B selected by the selecting unit 520 is applied to one end of m piezoelectric elements Pzt on the actuator substrate 40.

As described above, the four actuator substrates 40 corresponding to each color are arranged along the X direction, and one actuator substrate 40 is attached to a mounting plate 32 so that the longitudinal direction (nozzle arrangement direction) goes along the Y direction which is the sub-scanning direction.

In FIG. 13, the semiconductor circuit which is mounted on the COF 36, that is, the semiconductor circuit obtained by integrating the selection control unit 510 and the m selecting units 520 is not illustrated. In addition, in the example in FIG. 13, one end of the COF 36 is connected to the lower face of the relay board 24; however, a form of the connection can be arbitrary. Also the position of the actuator substrate 40 with respect to the relay board 24 is not limited to the lower face of the relay board 24.

Here, when assuming a configuration in which the mounting face of the drive circuit board 26 is placed along the Y direction which is the sub-scanning direction, in the configuration, when the carriage 20 reciprocates, and a lateral G-force in the X direction occurs, the attaching side becomes a fulcrum, there is a concern that the drive circuit board 26 remarkably wobbles with respect to the relay board 24 due to the lateral G-force, and solder in the input terminal 227 and the output terminal 229 may be released. In addition, when the mounting face of the drive circuit board 26 is placed along the Y direction, since it is orthogonal to the X direction which is the main scanning direction, there is large air resistance when reciprocating, and high speed reciprocating of the carriage 20 is hindered.

In contrast to this, since the mounting face of the drive circuit board 26 is erected along the X direction which is the main scanning direction, in the embodiment, even when a lateral G-force in the X direction occurs due to reciprocating of the carriage 20, the attaching side does not become a fulcrum. Accordingly, since the drive circuit board 26 does not wobble with respect to the relay board 24 due to the lateral G-force, stresses which occur in the input terminal 227 and the output terminal 229 are reduced, and it is possible to prevent releasing of solder, or the like.

In addition, since the mounting face of the drive circuit board 26 is placed along the X direction, air resistance at a time of reciprocating is reduced, and it does not hinder high-speed reciprocating of the carriage 20. When a heat radiating fin is provided in the transistors 231 and 232, it is possible to expect an improvement in cooling property.

Here, in order to exhibit the above described effects, the mounting face of the drive circuit board 26 may be attached in a state in which the mounting face is within a range of ±10 degrees in the main scanning direction.

It is not possible to expect a heat radiating effect at a reversing time in reciprocating, or at a stop time (standby time) of the carriage 20; however, since the driving signals COM-A and COM-B are constant in the voltage Vcen, and the transistors 231 and 232 are turned off together at the reversing time or the stop time, it is not a problem even when it is not possible to expect the heat radiating effect.

As in the embodiment, when the drive circuit boards 26 are mounted on both faces, and the input terminal 227 and the output terminal 229 are respectively provided on each face, since the output terminals 229 with a wide width are located on both the left and right sides when planarly viewing the drive circuit board 26, it is possible to improve attaching strength. In detail, since the output terminals 229 are located on the right side of the front surface when viewing thereof from the front surface of the drive circuit board 26, and the output terminals 229 which are provided on the rear surface are located on the left side when viewing thereof from the front surface, it is possible to improve attaching strength compared to a configuration in which the output terminals 229 are inclined to one side of the left and right sides.

In addition, as a matter of course, the drive circuit board may be mounted on one side, not both sides.

In the above descriptions, the example in which the drive circuit board 26 is attached to the relay board 24 in an erecting manner has been described; however, the drive circuit board 26 may be attached to the relay board 24 in an inclined state, when the mounting face of the drive circuit board 26 is placed along the movement direction of the carriage 20.

In the above descriptions, the drive circuit board 26 is attached to the relay board 24 through the input terminal 227 and the output terminal 229 using soldering. That is, the input terminal 227 and the output terminal 229 are caused to function as a support unit when fixing the drive circuit board 26 to the relay board 24.

As the support unit which fixes the drive circuit board 26 to the relay board 24, a configuration of hanging the drive circuit board 26, by fixing a top side of the drive circuit board 26 in the figure, or the like, can be taken into consideration, in addition to that.

In addition, in the above descriptions, the drive circuit board 26 is attached to the relay board 24 through the input terminal 227 and the output terminal 229 using soldering; however, it is preferable to adopt a configuration in which the drive circuit board can be exchanged with respect to the relay board 24 when considering handling of a failure, or the like.

Subsequently, an example in which the drive circuit board 26 can be exchanged with respect to the relay board 24 will be described.

Figure 15:
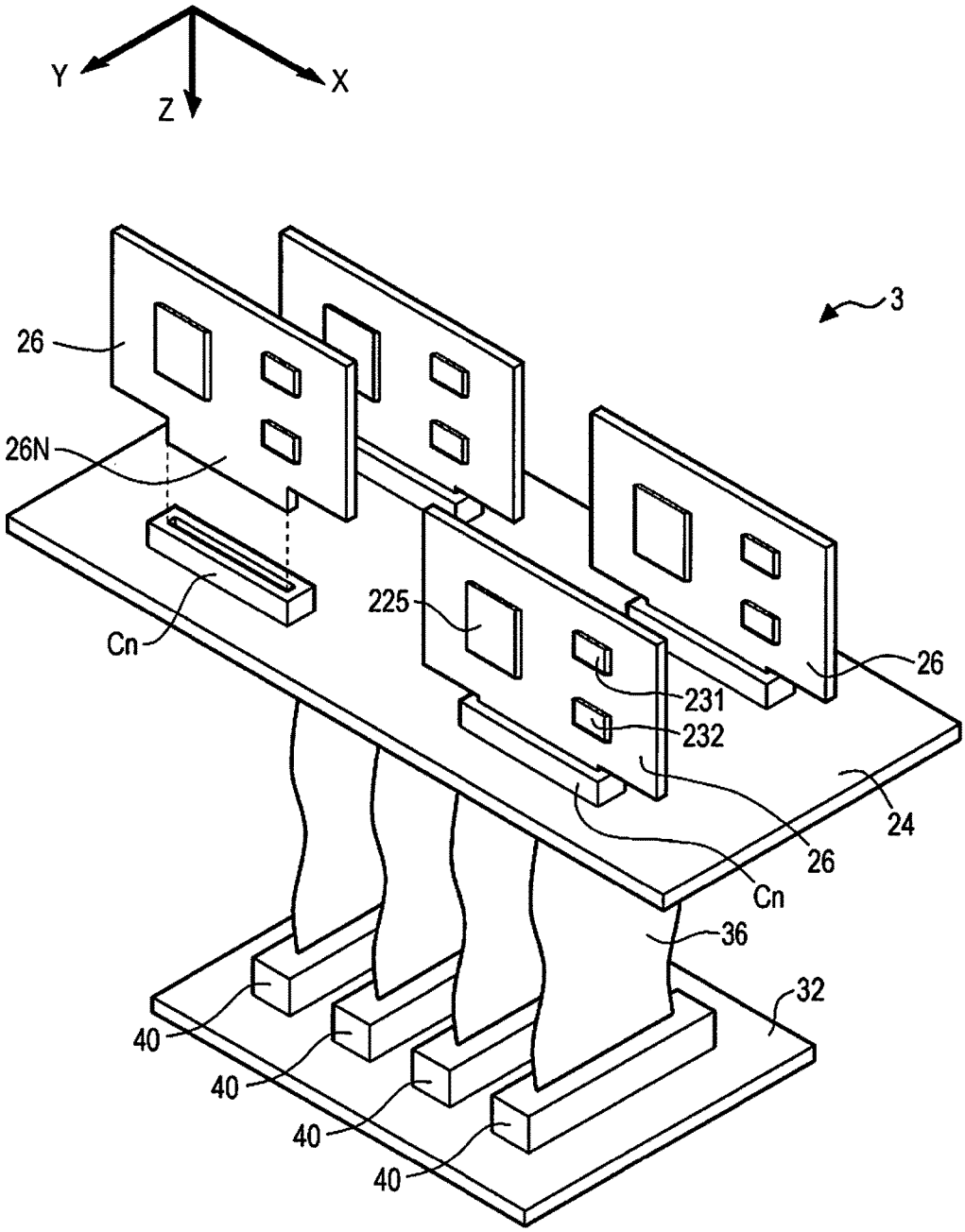
FIG. 15 is a perspective view which illustrates a separate connection structure of a substrate in the head unit.

FIG. 15 is a perspective view which illustrates a connection structure of a substrate in the head unit 3, in the configuration in which the drive circuit board 26 can be exchanged with respect to the relay board 24.

In the example illustrated in the figure, a part of the attaching side of the drive circuit board 26 becomes a protrusion portion 26N. Meanwhile, connectors Cn which correspond to each of the drive circuit boards 26 are provided on the relay board 24. It is configured so that the protrusion portion 26N of the drive circuit board 26 is inserted into the connector Cn, and the drive circuit board 26 is fixed to the relay board 24.

Though it is not illustrated, a plurality of wiring patterns are formed in the protrusion portion 26N, and a wiring pattern for inputting various signals from the control unit 110, a wiring pattern for outputting a driving signal, or the like, is included in the wiring pattern. Meanwhile, it is configured so that connecting points which correspond to each of the above described wiring patters are provided in the connector Cn, and the wiring patterns and the connecting points are respectively connected when the protrusion portion 26N is inserted into the connecting points.

According to such a configuration, it is possible to prevent the drive circuit board 26 from wobbling with respect to the relay board 24 even when the lateral G-force in the X direction occurs, reduce air resistance when perform reciprocating, and make assembling and exchange of the drive circuit board 26 easy.

In the above descriptions, the printing apparatus 1 has been described as the liquid ejecting apparatus; however, the liquid ejecting apparatus may be a three-dimensional shaping apparatus for shaping a three-dimensional object by ejecting liquid, a textile printing apparatus which dyes cloth by ejecting liquid, or the like.

The entire disclosure of Japanese Patent Application No. 2016-187878, filed Sep. 27, 2016 is expressly incorporated by reference herein.

What is claimed is:

1. A liquid ejecting apparatus comprising:

a drive circuit board on which a drive circuit which outputs a driving signal obtained by amplifying an original driving signal is mounted;

an ejecting unit which includes a piezoelectric element driven by the driving signal, and ejects liquid when the piezoelectric element is driven;

a relay board which relays the driving signal from the drive circuit board to the piezoelectric element; and a carriage on which the ejecting unit, the relay board, and the drive circuit board are mounted, and reciprocates in a main scanning direction, wherein the drive circuit board is attached to the relay board so that a mounting face of the drive circuit board is disposed in a direction which goes along the main scanning direction of the carriage, and the drive circuit board is connected to the relay board through a connector.

2. The liquid ejecting apparatus according to claim 1, wherein the drive circuit board includes an output terminal through which the driving signal is output, and an input terminal through which the original driving signal, or a signal other than the original driving signal is input.

3. The liquid ejecting apparatus according to claim 1, wherein a plurality of the drive circuit boards are provided.

4. The liquid ejecting apparatus according to claim 1, further comprising a support unit which supports the drive circuit board on the relay board.

5. The liquid ejecting apparatus according to claim 1, wherein the drive circuit includes a high side transistor which is connected between a predetermined output end and a feeding point of a high side power supply voltage, a low side transistor which is connected between the output end and a feeding point of a low side power supply voltage, a differential amplifier which outputs a control signal obtained by amplifying a differential voltage between a voltage of the original driving signal and a voltage corresponding to the driving signal, and a selector which, in a first case in which a change in voltage of the original driving signal is rising, and a magnitude of the change in voltage is a threshold value or more, selects the control signal, and causes the control signal to be supplied to a gate terminal of the high side transistor, and which, in a second case in which a change in voltage of the original driving signal is decreasing, and a magnitude of the change in voltage is the threshold value or more, selects the control signal, and causes the control signal to be supplied to a gate terminal of the low side transistor.

6. The liquid ejecting apparatus according to claim 5, wherein, in the first case, the selector selects a signal which turns off the low side transistor, and supplies the signal to a gate terminal of the low side transistor, and in the second case, the selector selects a signal which turns off the high side transistor, and supplies the signal to a gate terminal of the high side transistor.

7. The liquid ejecting apparatus according to claim 6, wherein, in a third case in which a magnitude of the change in voltage is less than the threshold value, the selector selects a signal which turns off the low side transistor, and causes the signal to be supplied to the gate terminal of the low side transistor, and selects a signal which turns off the high side transistor, and causes the signal to be supplied to the gate terminal of the high side transistor.

8. A liquid ejecting apparatus comprising:

a drive circuit board on which a drive circuit which outputs a driving signal obtained by amplifying an original driving signal is mounted;

an ejecting unit which includes a piezoelectric element driven by the driving signal, and ejects liquid when the piezoelectric element is driven;

a relay board which relays the driving signal from the drive circuit board to the piezoelectric element; and a carriage on which the ejecting unit, the relay board, and the drive circuit board are mounted, and reciprocates in a main scanning direction, wherein the drive circuit board is attached to the relay board so that a mounting face of the drive circuit board is disposed in a direction which goes along the main scanning direction of the carriage, the drive circuit is mounted on one face of the drive circuit board, a separate drive circuit is mounted on the other face of the drive circuit board, and the relay board relays a driving signal generated by the separate drive circuit to the piezoelectric element from the drive circuit board.

9. The liquid ejecting apparatus according to claim 8, wherein the drive circuit board includes an output terminal through which the driving signal is output, and an input terminal through which the original driving signal, or a signal other than the original driving signal is input.

10. The liquid ejecting apparatus according to claim 8, wherein a plurality of the drive circuit boards are provided.

11. The liquid ejecting apparatus according to claim 8, further comprising a support unit which supports the drive circuit board on the relay board.

12. The liquid ejecting apparatus according to claim 8, wherein the drive circuit includes a high side transistor which is connected between a predetermined output end and a feeding point of a high side power supply voltage, a low side transistor which is connected between the output end and a feeding point of a low side power supply voltage, a differential amplifier which outputs a control signal obtained by amplifying a differential voltage between a voltage of the original driving signal and a voltage corresponding to the driving signal, and a selector which, in a first case in which a change in voltage of the original driving signal is rising, and a magnitude of the change in voltage is a threshold value or more, selects the control signal, and causes the control signal to be supplied to a gate terminal of the high side transistor, and which, in a second case in which a change in voltage of the original driving signal is decreasing, and a magnitude of the change in voltage is the threshold value or more, selects the control signal, and causes the control signal to be supplied to a gate terminal of the low side transistor.

13. The liquid ejecting apparatus according to claim 12, wherein, in the first case, the selector selects a signal which turns off the low side transistor, and supplies the signal to a gate terminal of the low side transistor, and in the second case, the selector selects a signal which turns off the high side transistor, and supplies the signal to a gate terminal of the high side transistor.

14. The liquid ejecting apparatus according to claim 13, wherein, in a third case in which a magnitude of the change in voltage is less than the threshold value, the selector selects a signal which turns off the low side transistor, and causes the signal to be supplied to the gate terminal of the low side transistor, and selects a signal which turns off the high side transistor, and causes the signal to be supplied to the gate terminal of the high side transistor.

* * * * *